US010750796B2

(12) United States Patent
Farron et al.

(10) Patent No.: US 10,750,796 B2
(45) Date of Patent: Aug. 25, 2020

(54) FREEDOM OF MOVEMENT GARMENT

(71) Applicant: NIKE, Inc., Beaverton, OR (US)

(72) Inventors: Daniel E. Farron, Amsterdam (NL); Scott K. Hutsenpiller, Portland, OR (US); Lindsey V. J. Martin, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 85 days.

(21) Appl. No.: 15/299,200

(22) Filed: Oct. 20, 2016

(65) Prior Publication Data

US 2017/0035122 A1 Feb. 9, 2017

Related U.S. Application Data

(63) Continuation-in-part of application No. 14/850,193, filed on Sep. 10, 2015, now Pat. No. 10,219,554, (Continued)

(51) Int. Cl.
*A41D 3/02* (2006.01)
*A41D 1/04* (2006.01)
(Continued)

(52) U.S. Cl.
CPC ..... *A41D 3/02* (2013.01); *A41D 1/04* (2013.01); *A41D 3/00* (2013.01); *A41D 13/0015* (2013.01);
(Continued)

(58) Field of Classification Search
CPC ... A41D 1/02; A41D 1/04; A41D 3/02; A41D 3/04; A41D 15/00; A41D 31/02;
(Continued)

(56) References Cited

U.S. PATENT DOCUMENTS 1,190,504 A 7/1916 Bernstein
1,361,892 A 12/1920 Naterman
(Continued)

FOREIGN PATENT DOCUMENTS

CH 680036 A5 6/1992
CN 2232210 Y 8/1996
(Continued)

OTHER PUBLICATIONS

International Preliminary Report on Patentability dated Mar. 22, 2018 in International Patent Application No. PCT/US2016/050991, 8 pages.
(Continued)

*Primary Examiner* — Katharine Gracz
(74) *Attorney, Agent, or Firm* — Shook, Hardy and Bacon LLP

(57) ABSTRACT

Aspects herein relates to a garment designed to provide an enhanced range of motion. This is accomplished by having a layered construction comprising different fabric/textile materials where the enhanced range of motion is desired. The garment in accordance with aspects herein particularly provides an enhanced range of motion for a wearer around the shoulders and arms. This enhanced range of motion may be especially beneficial when the wearer is engaged in a physically demanding activity or any activity benefitting from a wide range of movement by the wearer's arms and shoulders.

20 Claims, 19 Drawing Sheets

Related U.S. Application Data which is a continuation-in-part of application No. 13/673,260, filed on Nov. 9, 2012, now Pat. No. 10,004,280.

(51) Int. Cl.

| | |
|---|---|
| ***A41D 3/00*** | (2006.01) |
| ***A41D 13/00*** | (2006.01) |
| ***A41D 31/14*** | (2019.01) |
| *A41D 27/04* | (2006.01) |
| *A41D 15/00* | (2006.01) |
| *A41D 27/10* | (2006.01) |

(52) U.S. Cl.

CPC ..... *A41D 31/14* (2019.02); *A41D 15/007* (2013.01); *A41D 27/04* (2013.01); *A41D 27/10* (2013.01); *A41D 2200/00* (2013.01); *A41D 2400/44* (2013.01); *A41D 2600/10* (2013.01)

(58) Field of Classification Search

CPC .. A41D 3/00; A41D 13/0015; A41D 2400/44; A41D 15/007; A41D 2200/00; A41D 2400/20; A41D 27/10; A41D 27/04

USPC ..... 2/85, 86, 88, 89, 91, 92, 94, 96, 95, 93, 2/97, 102, 103, 106, 113, 114, 125, 309, 2/913

See application file for complete search history.

(56) References Cited

U.S. PATENT DOCUMENTS

| | | | | |
|---|---|---|---|---|
| 2,159,408 | A | 8/1936 | Siegel | |
| 2,177,543 | A | 10/1939 | Vecchi | |
| RE21,676 | E | 12/1940 | Shane | |
| 2,270,435 | A | 1/1942 | Hansen | |
| 2,279,761 | A * | 4/1942 | Schatten | A41D 27/10 2/93 |
| 2,322,451 | A | 6/1943 | Jones | |
| 2,330,520 | A * | 9/1943 | Saveth | A41D 27/10 2/74 |
| 2,361,380 | A * | 10/1944 | Callahan | A41D 3/04 2/87 |
| 2,514,276 | A | 2/1947 | Berman | |
| 2,614,258 | A | 10/1952 | Breier | |
| 2,707,786 | A | 5/1955 | Stoner | |
| 3,049,719 | A | 8/1962 | Hyman | |
| 3,231,899 | A | 2/1966 | Seidel et al. | |
| 4,195,362 | A * | 4/1980 | Rolando | A41D 3/00 2/108 |
| 4,320,538 | A | 3/1982 | Sall | |
| 4,608,715 | A * | 9/1986 | Miller | A41D 27/285 2/1 |
| 4,864,656 | A | 9/1989 | Nesse | |
| 4,937,884 | A | 7/1990 | Sherman | |
| 4,999,850 | A | 3/1991 | Grilliot et al. | |
| 5,687,423 | A | 11/1997 | Ross | |
| 6,053,852 | A | 4/2000 | Wilkinson | |
| 6,895,597 | B1 | 5/2005 | Rakic | |
| 7,028,342 | B1 * | 4/2006 | Nordstrom | A41D 1/04 2/119 |
| 7,117,539 | B1 | 10/2006 | Baacke | |
| 7,343,629 | B2 | 3/2008 | Hunt | |
| 7,578,005 | B2 | 8/2009 | Vereen | |
| 7,636,948 | B1 | 12/2009 | Crye et al. | |
| 7,770,234 | B2 | 8/2010 | Roux et al. | |
| 7,966,668 | B2 | 6/2011 | Bay | |
| 8,209,773 | B2 | 7/2012 | Bothwell | |
| 2004/0064869 | A1 | 4/2004 | Deadwyler | |
| 2007/0028351 | A1 | 2/2007 | Coolik | |
| 2008/0005825 | A1 | 1/2008 | Tronvold | |
| 2008/0060113 | A1 * | 3/2008 | Walsh | A41D 27/10 2/116 |
| 2009/0070914 | A1 | 3/2009 | Landeck et al. | |
| 2009/0247046 | A1 | 10/2009 | Fine | |
| 2010/0031415 | A1 | 2/2010 | Shadid | |
| 2010/0186136 | A1 | 7/2010 | Blauer et al. | |
| 2010/0199403 | A1 | 8/2010 | Greenblat | |
| 2010/0203803 | A1 | 8/2010 | Murphy et al. | |
| 2011/0088135 | A1 | 4/2011 | Snyder et al. | |
| 2011/0179547 | A1 * | 7/2011 | Stoneham | A41B 13/005 2/80 |
| 2015/0374050 | A1 | 12/2015 | Farron et al. | |
| 2016/0331052 | A1 * | 11/2016 | West | A41D 27/02 |

FOREIGN PATENT DOCUMENTS

| | | | |
|---|---|---|---|
| CN | 1714690 | A | 1/2006 |
| CN | 101584501 | A | 11/2009 |
| CN | 201509616 | U | 6/2010 |
| CN | 202112343 | U | 1/2012 |
| CN | 202311338 | U | 7/2012 |
| CN | 102669843 | A | 9/2012 |
| CN | 202425666 | U | 9/2012 |
| CN | 203492806 | U | 3/2014 |
| EP | 1862085 | A2 | 12/2007 |
| GB | 866848 | A | 5/1961 |
| GB | 2437699 | A | 7/2007 |
| JP | S4217929 | Y1 | 10/1967 |
| JP | S6296202 | A | 5/1987 |
| JP | H09170106 | A | 6/1997 |
| JP | 2002339120 | A | 11/2002 |
| JP | 3167570 | U | 4/2011 |
| WO | 2017044778 | A1 | 3/2017 |

OTHER PUBLICATIONS

Notice of Allowance dated Mar. 26, 2018 in U.S. Appl. No. 13/673,260, 7 pages.

Final Office Action dated Jun. 15, 2018 in U.S. Appl. No. 14/850,193, 15 pages.

Non-Final Office Action dated May 12, 2017 in U.S. Appl. No. 13/673,260, 13 pages.

Final Office Action dated Jan. 26, 2017 in U.S. Appl. No. 13/673,260, 13 pages.

Non-Final Office Action dated Nov. 1, 2017 in U.S. Appl. No. 14/850,193, 15 pages.

European Office Action dated Jul. 12, 2017 in European Patent Application No. 13853319.5, 4 pages.

Final Office Action dated Nov. 14, 2017 in U.S. Appl. No. 13/673,260, 15 pages.

International Search Report and Written Opinion dated Jan. 2, 2018 in International Patent Application No. PCT/US2017/057602, 15 pages.

International Search Report with Written Opinion dated Nov. 29, 2016 in International Application No. PCT/US2016/050991, 8 pages.

Notice of Allowance dated Oct. 16, 2018 in U.S. Appl. No. 14/850,193, 9 pages.

Extended search report dated Dec. 6, 2018 in European Patent Application No. 18177024.9, 9 pages.

Communication under Rule 71(3) dated Feb. 8, 2019 in European Patent Application No. 16766806.0, 5 pages.

International Preliminary Report on Patentability dated May 2, 2019 in International Patent Application No. PCT/US2017/057602, 9 pages.

Office Action received for European Patent Application No. 18177024.9, dated Feb. 19, 2020, 3 pages.

Office Action received for European Patent Application No. 17791909.9, dated May 27, 2020, 6 pages.

* cited by examiner

FREEDOM OF MOVEMENT GARMENT

CROSS-REFERENCE TO RELATED APPLICATIONS

This application entitled "Freedom of Movement Garment," is a continuation-in-part application of co-pending U.S. patent application Ser. No. 14/850,193 filed Sep. 10, 2015, and entitled "Freedom of Movement Garment," which is a continuation-in-part application of U.S. patent application Ser. No. 13/673,260 filed Nov. 9, 2012, and entitled "Freedom of Movement Garment." The entireties of the aforementioned applications are incorporated by reference herein.

STATEMENT REGARDING FEDERALLY SPONSORED RESEARCH OR DEVELOPMENT

Not applicable.

TECHNICAL FIELD

Aspects herein relates to garments and/or coats that are not restrictive and allow a wearer to have an enhanced range of motion. Aspects herein offers several practical applications in the technical arts, not limited to athletic wear, casual wear, etc. More particularly, aspects herein relates to apparel that affords freedom of movement around the shoulders and arms of a wearer, especially when engaged in a physically demanding activity or any activity benefitting from a wide range of movement by the wearer's arms and shoulders.

BACKGROUND OF THE INVENTION

Garments are constructed from different types of materials that have different stretchabilities or elastic characteristics. Additionally, depending on the placement of garment seams, the garments may diminish the range of motion afforded to the upper limbs of a wearer when the garment is worn. Further, cooler weather often requires a person wear extra layers of clothing when outdoors. The extra layers of clothing may additionally contribute to the restrictions on the range of motion of a wearer, especially when the wearer is engaging in an athletic activity, or any other type of physical activity.

Conventionally all types or garments are made from materials such as leather, synthetic fabrics and/or natural fabrics that are knit or woven, non-woven fabrics, thermoplastic materials, and the like. The downside of using these materials especially when treated to make them water repellent and/or wind repellent, may be that these materials may not have enough stretchability and/or breathability, or the stretchability and/or breathability may be minimal especially when the garments comprise chemical treatments.

BRIEF DESCRIPTION OF THE DRAWINGS

Aspects herein is described in detail below with reference to the attached drawing figures, wherein.

DETAILED DESCRIPTION OF THE INVENTION

Figure 1:
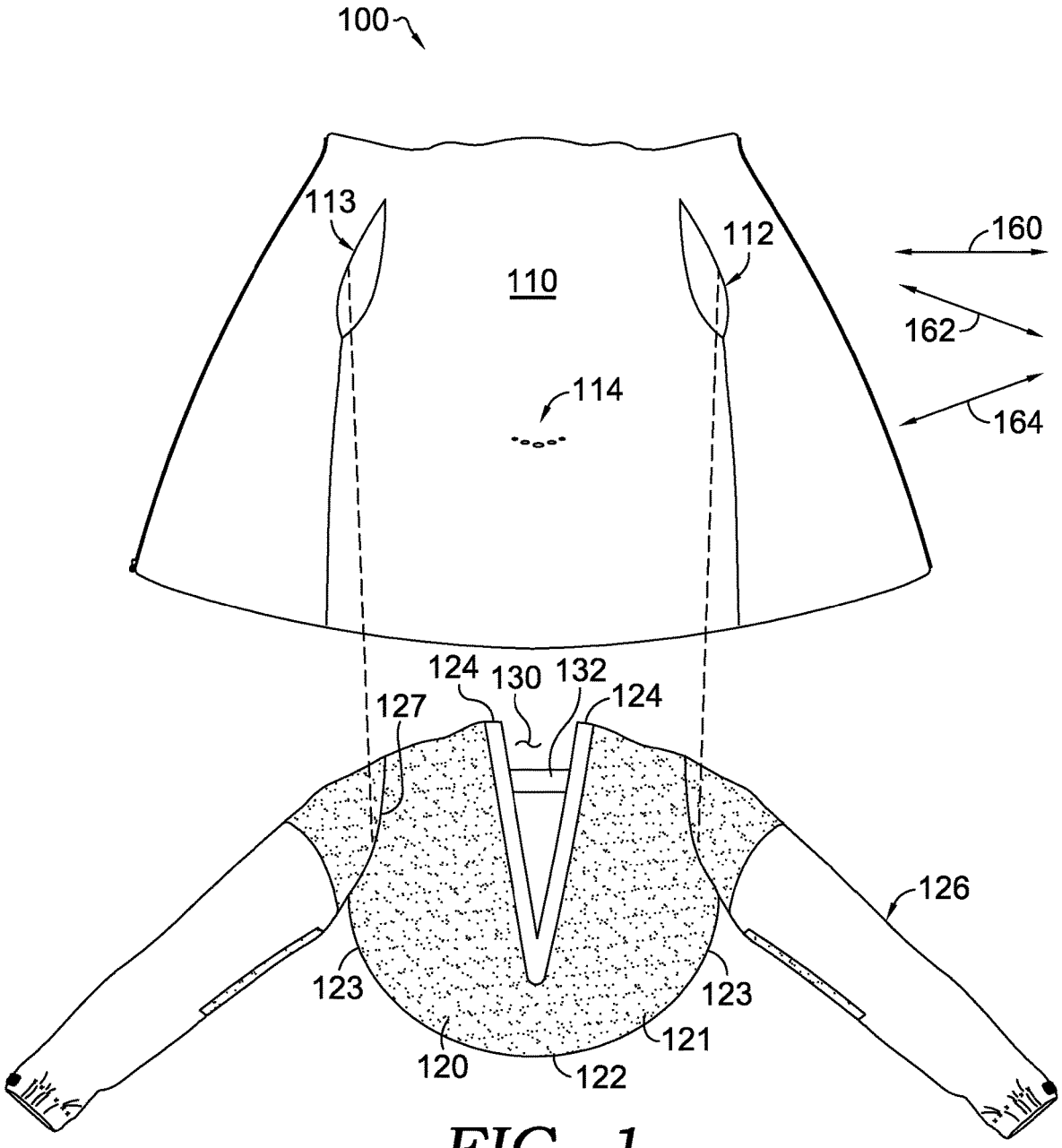
FIG. 1 is a deconstructed view of an exemplary jacket/coat in accordance with aspects herein.

Aspects herein provide upper body garments with enhanced range of motion around the shoulders and the arms of the wearer. In addition to an enhanced range of motion, the garments in accordance with aspects herein provide ventilation without compromising protection from the environmental elements.

An object of the technology described herein is to provide a garment that is comfortable and can be layered with other garments without restricting the range of motion of the arms and shoulders of a wearer. The garment in accordance with aspects herein may have a layered construction where different layers of the garment may comprise the same or even different types of fabrics/textiles and/or pliable materials to achieve a comfortable wear for the wearer.

In a first example, the garment may comprise a partial shrug portion (without front pieces covering the chest area of a wearer when the garment is worn) with a back panel, and with sleeves attached to the back panel. The sleeves may be attached to the back panel by a seam, or alternatively, they may be continuous (no seams/seamlessly adjacent) with the back panel. Each sleeve of the partial shrug portion may comprise a front side edge. The sleeves may be long sleeves, short sleeves, three-quarter sleeves, or any other length desired for the particular style and use for the garment. The partial shrug portion may be constructed from an elastic and/or partially elastic type of material that may be knit or woven.

The partial shrug portion may optionally have a strain-relieving cutout on its back panel. The strain-relieving cutout may be triangular, for example, and may optionally have an elastic stabilizer to stabilize the cutout. For example, the cutout may have downward pointing triangular shape with a stabilizing elastic band across the wide end of the triangle closer to the collar of the garment.

The garment may further comprise a vest portion comprising at least one front panel and at least one back panel, where the length of the at least one front panel and the at least one back panel may determine the full length of the garment. In other words, the at least one back panel of the vest portion may be longer than the back panel of the partial shrug portion. The vest portion may extend over the partial shrug portion, and the at least one front panel and the at least one back panel of the vest portion when affixed to each other, may define, in part, a collar opening, right and left sleeve openings, and a waist opening for the garment.

The front side edges of the sleeves of the partial shrug portion when extended through the sleeve openings of the vest portion, may be seamed only to the front edges of the respective sleeve openings of the vest, while being completely detached from remaining portions of the sleeves of the partial shrug portion/remaining portions of the sleeve openings of the vest portion. In other words, the sleeves of the partial shrug portion may essentially be free-floating from the sleeve openings of the vest portion but for the affixed front side edges of the sleeves/front edges of the sleeve openings so that when a wearer needs to stretch his/her back by pulling his/her arms forward, or in any other direction, this motion may be performed freely without strain caused by conventional sleeve constructions.

The vest portion may be constructed from the same stretchable material as the partial shrug portion, or alternatively, may be constructed from a different material from the shrug portion. For example, the partial shrug portion may be constructed from a stretch knit fabric/textile, while the vest portion may be constructed from a stretch woven fabric/textile. One of ordinary skill will recognize that both stretch knit and stretch woven fabrics/textiles are stretchable materials having a particular modulus of elasticity depending on their composition and woven or knit pattern. A stretchable material may be a four-way stretchable fabric/textile, a two-way stretchable fabric/textile, a composite material, a sheet-type material, and the like. The partial shrug portion and the vest portion may be formed from inherently breathable materials that allow vapor moisture and heat to travel between an environment interior to the garment and an environment exterior to the garment. Further, the breathable materials may comprise moisture management properties that actually pull moisture (e.g., from perspiration) away from a wearer of the garment, in order to maintain a dry feeling for the wearer. Alternatively, the partial shrug portion and/or the vest portion may be water-resistant or waterproof either inherently or due to a waterproofing treatment. Moreover, if water-resistance or waterproofing is desired, an elastic and waterproof layer of a polymer material may be applied to the inner face and/or outer face of the material prior to making the garment. Another desirable property for the materials used in the construction of the garments in accordance with aspects herein is the resistance to UV radiation, in particular when the garments are meant to be worn outdoors and have full or partial exposure to direct sunlight when worn.

The back panel of the partial shrug portion may be affixed to a back panel of the vest portion near the bottom edge of the back panel of the shrug portion by a bottom edge seam. Conceivably, in the case where the garments are made from waterproof materials, rain or other environmental precipitation, or other water source, could potentially enter through the gap on the back created where the sleeves are detached "free-floating," and may accumulate in between the partial shrug portion and the vest portion near the bottom edge seam area. Therefore, the garment in accordance with aspects herein may be provided with a plurality of perforations on the vest portion, slightly above the bottom edge seam of the partial shrug portion between the partial shrug portion and the vest portion to allow the water to drain out without actually accumulating.

The bottom edge seam may follow the shape of the bottom edge of the back panel of the partial shrug portion. For example, the bottom edge seam may be completely straight and horizontal, or the bottom edge seam may be at an angle. The angle may play an important role when the materials used are waterproof or water-resistant because the angle may serve to guide any water present between the vest portion and the partial shrug portion towards the plurality of perforations for more efficient water draining. Depending on where the plurality of perforations are located, the seam angle may be adjusted to achieve both aesthetic and/or functional purposes. For example, if the perforations are in the middle of the back of the garment, the bottom edge seam may form a slight semi-circular, or a flattened "V" shape angled just enough to guide the water toward the center, where gravity may work to pull the water down and out of the garment through the plurality of perforations. The bottom edge seam may be formed by for example using an adhesive to adhere the meeting surfaces of the vest portion and the bottom edge of the partial shrug portion.

In a different example of the garment in accordance with aspects herein, the garment may comprise a shrug portion made out of a strong and flexible mesh-type material, or any other desired breathable material. The material forming the shrug portion may be made from synthetic and/or natural fibers, and additionally, may contain elastic fibers to add elasticity to the material. The sleeves of the garment may be attached to the shrug portion at the sleeve openings of the shrug portion. The sleeves may be of any length desired for the garment, such as short, three-quarter, long, etc., and may be pieced together from different types of materials with differing properties such as elasticity, resiliency, and the like.

The garment may further comprise a longer vest portion over the shrug portion. The shrug portion may be free-floating inside the vest portion except for the seams at the collar, the bottom edge, and the front edges of the shrug portion. Since in this garment construction, the sleeves are completely detached/free-floating from the stiffer vest portion at the sleeve openings of the vest portion, this construction may provide ventilation as well as enhanced range of motion in the shoulder are of a wearer, particularly when the wearer pulls his/her arms forward, or when a wearer lifts his/her arms above his/her shoulders.

In an additional example in accordance with aspects herein, a garment formed from a shrug component and a partial vest component may be provided. In accordance with the present example, the shrug component may comprise at least one front panel, at least one back panel, a right sleeve, and a left sleeve. The vest component may comprise at least one front panel and at least one back panel, wherein the front and back panels may be affixed or attached to each other at left and right side seams, to form in part a right sleeve opening or sleeve opening and a left sleeve opening or sleeve opening. In the alternative, the at least one front panel and the at least one back panel may be formed from a single piece of material. As used throughout this disclosure, the terms affixed or attached mean permanently joined to one another using affixing technologies known in the art such as stitching, bonding, welding, and the like. Continuing, the shoulder seams of the vest component may not be attached to each other but rather, they may be attached/seamed to front and back shoulder portions of the right sleeve and left sleeve of the shrug component when the vest component and the shrug component are assembled together to form the garment. Further attachment points between the shrug component and the vest component may include the garment collar, a bottom edge of the shrug component, and in the case that the garment is a front opening jacket, at front edges of the garment where a releasable closing mechanism for the jacket may be provided. However, the shrug component and the vest component may not be attached to each other at portions where the right sleeve and the left sleeve of the shrug component meet the sleeve opening edges of the vest component.

Yet, in a different example of the garment in accordance with aspects herein, a thick winter garment in the form of a jacket/coat may be provided, the garment comprising at least one front panel and at least one back panel, wherein the at least one front panel and the at least one back panel cooperate with each other to define, in part, a collar opening, a right and a left sleeve opening, and a waist opening. The right and left sleeves of the garment may be attached to the respective sleeve openings as further described hereon. Since winter jackets tend to be bulky for insulating purposes, inevitably, they may have limited breathability and may be restrictive and not allow a user full range of motion. Therefore, the garment in accordance with aspects herein, may comprise composite sleeves, which may provide breathability and/or enhanced range of motion without compromising insulation from cold weather. In other words, each of the sleeves may comprise three different sections: a lower sleeve, an upper sleeve and a cover sleeve. The lower sleeve may be constructed in the same way and with the same materials as the rest of the garment including the insulating fibers, and may cover an arm anywhere from the wrist up to the elbow of a wearer when the garment is in an as-worn configuration. The upper sleeve may comprise a flexible and resilient mesh-type, or any other breathable and elastic type of material and may be attached to the lower sleeve by a seam. The upper sleeve may cover the arm of the wearer up to the shoulder of the wearer and may be attached to the garment at a seam around the sleeve openings defined by the at least one front panel and the at least one back panel of the garment. Finally, the cover sleeve may also be constructed from the same materials as the rest of the garment, including the insulating fibers, and may also be attached to the garment by a seam connecting it to the sleeve opening defined by the at least one front panel and the at least one back panel of the garment similar the upper sleeve. The cover sleeve may extend from the sleeve opening defined by the at least one front panel and the at least one back panel of the garment to slightly below the upper sleeve in order to completely conceal the upper sleeve when the arms of the wearer are in a rest position parallel to the wearer's body when the garment is in the as-worn configuration. It may be noted that the length ratios of the upper and lower sleeves may be other than the one described above, and the length of the cover sleeve may also be changed accordingly.

The garment with the composite sleeves described above may allow for improved airflow between the inside and outside of the garment and may provide enhanced flexibility for the wearer due to the flexibility provided by the upper sleeve material, thereby enhancing comfort for the wearer. In other words, the composite sleeve construction in accordance with aspects herein, may provide enhanced temperature regulation, as well as an enhanced range of motion for the wearer by allowing the stretching (lengthening) of the sleeve as required by the motions performed by the wearer.

In yet another aspect in accordance with the present technology, the garment may comprise a shrug component comprising at least a back shrug panel, a first sleeve having a first front edge, and a second sleeve having a second front edge when the garment is in an-as worn configuration, and a vest component extending over the shrug component, the vest component having at least one front panel and at least one back panel. The at least one front panel and the at least one back panel, when joined to form the vest component, are configured to define, in part, at least a neckline opening, a first sleeve opening, a second sleeve opening, and a waist opening. The first sleeve opening is defined by at least a first front edge and the second sleeve opening is defined by at least a second front edge. The first sleeve of the shrug component is extended through the first sleeve opening of the vest component and the second sleeve of the shrug component is extended through the second sleeve opening of the vest component. In accordance with aspects herein, the first front edge of the first sleeve of the shrug component is joined to the front edge of the first sleeve opening of the vest component and the second front edge of the second sleeve of the shrug component is joined to the front edge of the second sleeve opening of the vest component so that the first sleeve opening and the second sleeve opening of the vest component are fully detached from remaining portions of the first sleeve and the second sleeve of the shrug component.

In another aspect, a method for manufacturing the garment is described, where the method comprises the steps of: providing a shrug component comprising at least one back shrug panel, a first sleeve having a first front edge, and a second sleeve having a second front edge; providing a vest component comprising at least one front panel, and at least one back panel, wherein the at least one front panel and the at least one back panel, when joined to form the vest component define, in part, at least a neckline opening, a first sleeve opening, a second sleeve opening, and a waist opening; extending the vest component over the shrug component; affixing the first front edge of the first sleeve of the shrug component to a first front edge of the first sleeve opening of the vest component and affixing the second front edge of the second sleeve of the shrug component to the second front edge of the second sleeve opening of the vest component so that the first sleeve opening and the second sleeve opening of the vest component are fully detached from remaining portions of the first sleeve and the second sleeve of the shrug component. Additional objects, advantages, and novel features of the invention will be set forth in part in the following description and figures.

Referring now to FIG. 1, a deconstructed jacket/coat 100 in accordance with aspects herein is shown. As shown in FIG. 1, the jacket/coat 100 comprises two main components, a partial shrug portion 120 (only covering the back area of a wearer when worn, i.e. not comprising a front panel(s) covering the chest area of a wearer when worn) comprising the sleeves 126 and back panel 121, and a vest portion 110 comprising the full length of the jacket/coat 100.

Figure 14:
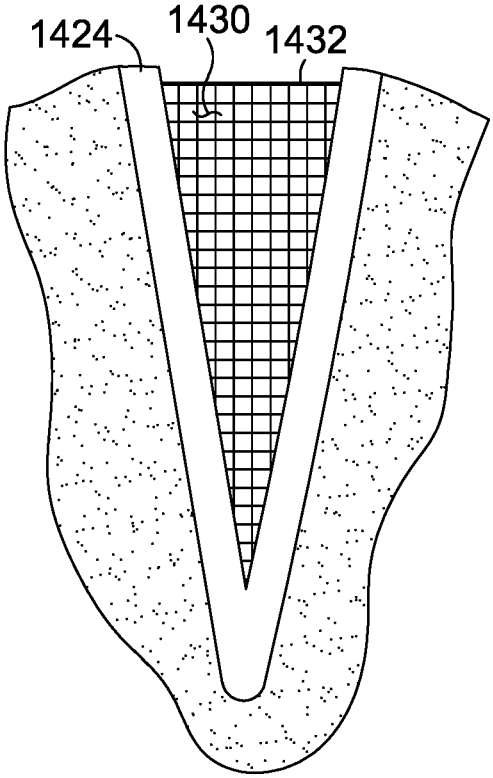
FIGS. 14 and 15 illustrate examples of alternative strain-relieving cutouts for jackets/coats in accordance with aspects herein.
Figure 15:
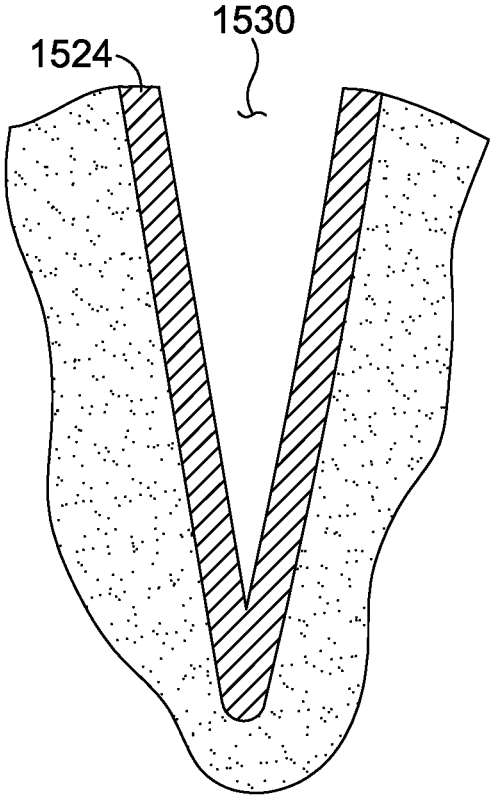

The partial shrug portion 120 may comprise a more elastic material than the vest portion 110. Further, the partial shrug portion 120 may comprise a strain-relieving cutout 130 extending, for example approximately 0.5 to 5 inches above the bottom rounded edge 122 of the partial shrug portion 120, up to and including the collar edge 124 of the partial shrug portion 120. The strain-relieving cutout 130, may be stabilized by an elastic stabilizer 132 located approximately 0.5 to 5 inches below the cutout collar edge 124, where the collar seam would have been. The strain-relieving cutout 130 may be shaped like a "V" as shown, or any other shape suitable for its intended purpose. Elastic stabilizer 132 may be omitted or replaced, for example with a mesh. Examples of some alternative strain-relieving cutouts are depicted in FIGS. 14 and 15. FIG. 14 shows a V-shaped strain-relieving cutout 1430 with an edge 1424 stabilized with a mesh insert 1432, which may be stretchable. FIG. 15 shows a V-shaped strain-relieving cutout 1530 with a reinforced edge 1524 that maintains its form during use. Reinforced edge 1524 may be formed using layering, laminates, plastic inserts, metal inserts, seam tape, elastomers, etc. While the examples of strain-relieving cutouts suitable for use in a jacket/coat in accordance with aspects herein have been illustrated with a V-shape, other shapes, such as a U-shape, may be used.

The sleeves 126 of the jacket/coat in accordance with aspects herein may optionally be an integral and continuous part of the partial shrug portion 120. The sleeves 126 may comprise the same elastic material as the partial shrug portion, at least up to the region of the sleeves 126 covering the upper arm above the elbow, and the elbow region (as shown). In a different example, the sleeves 126 may comprise the same elastic material as the partial shrug portion all the way to the wrist potion. In yet a different example of aspects herein, the sleeves 126 may be convertible between a short sleeve and a long sleeve, for example by having a zipper with a zipper flap covering the zipper, dividing the sleeves 126, just above the elbow, into an upper sleeve and lower sleeve. The zipper may be used to attach or detach the lower-sleeve portion from the upper-sleeve portion of the jacket/coat 100, at the convenience of the user.

Moving on to the construction of the jacket/coat 100 in accordance with aspects herein, the vest portion 110 comprising the full-length of the jacket/coat 100, may be placed over and attached to the partial shrug portion 120 at the bottom rounded edge 122, and side edges 123 of the partial shrug portion 120. Only the front edge 127 of the sleeves 126 may be attached to the front edge 113 of the sleeve opening 112 in the vest portion 110. In other words, there may be no seams on the back and shoulders of the jacket/coat 100 in accordance with aspects herein. Therefore, since essentially, a "pocket" (accessible at the shoulders from the back) is formed between the partial shrug portion 120 and the vest portion 110, perforations 114 are provided on the vest portion 110 slightly above the seam with the bottom rounded edge 122 of the partial shrug portion 120. The perforations 114 may serve as a water-draining mechanism in case water slips into the "pocket" in the event that the jacket/coat is worn during rainy weather.

The jacket/coat 100 in accordance with aspects herein may be made from a combination of water-resistant fabrics that may have additional differing properties such as added elasticity. Elasticity in such a fabric may be substantially multi-directional or may be operative only in some directions. For example, one or more material used in constructing a garment in accordance with aspects herein may comprise a four-way stretch textile, a two-way stretch textile, or other materials with desired properties. Textiles used may provide desired stretch properties based upon material selection, such as spandex and/or spandex blends, and/or structural properties, such as knits providing a degree of mechanical stretch. If a textile with predominantly two-way stretch along a single axis is chosen, that axis may be oriented substantially horizontally when the jacket is worn, as indicated at 160, or at any bias to horizontal, as indicated at 162 and 164. Optionally, different textile portions used in constructing a jacket in accordance with aspects herein may have different stretch properties and/or different orientations. Further, the fabrics may comprise an elastomer waterproofing coating material, optionally with at least the same elastic characteristics as the fabrics themselves. The different seams for constructing the jacket/coat 100 in accordance with aspects herein may be formed by stitching, welding (using adhesive materials), or a combination of both.

Figure 2:
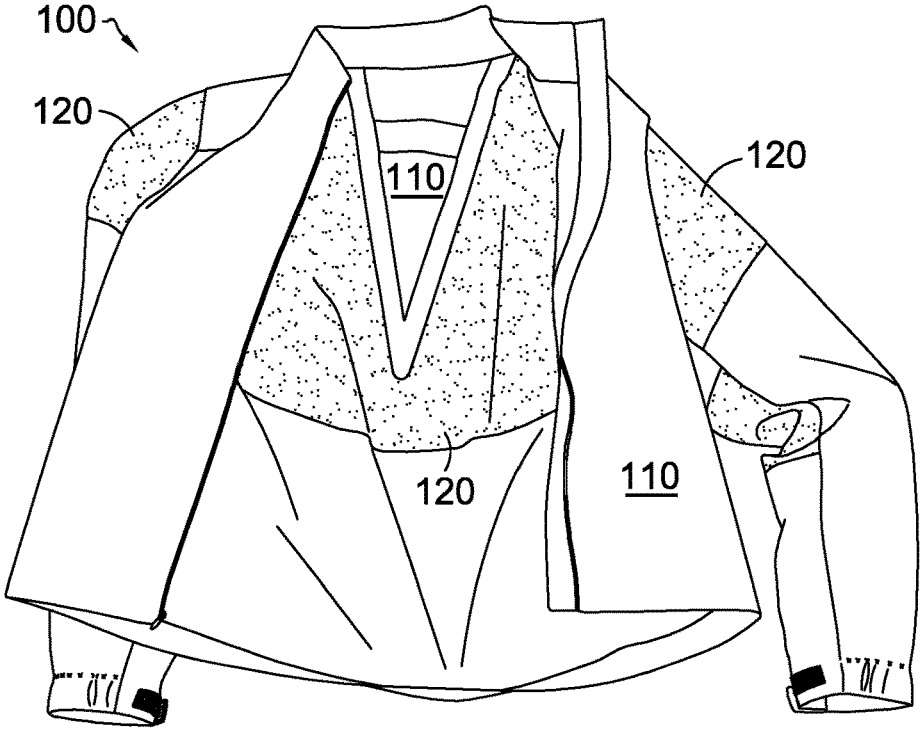
FIG. 2 is a layered front view of the exemplary jacket/coat shown in FIG. 1.
Figure 3:
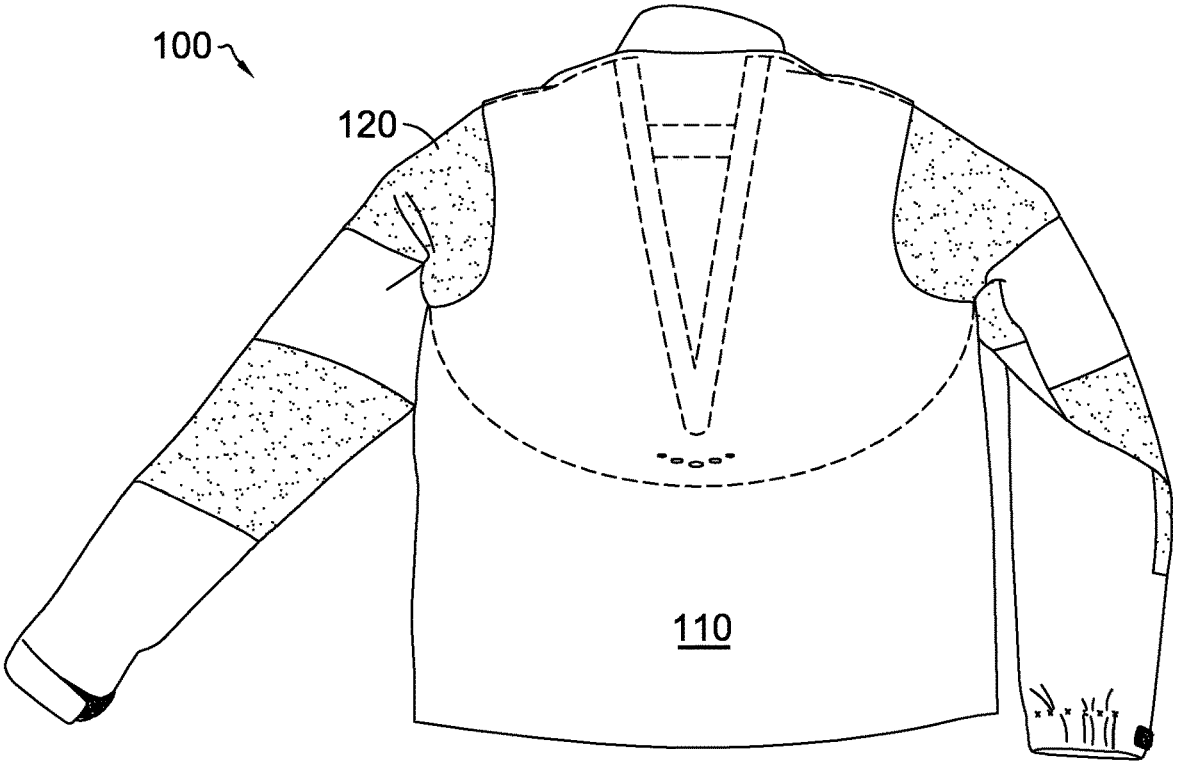
FIG. 3 is a layered back view of the exemplary jacket/coat shown in FIG. 1.
Figure 4:
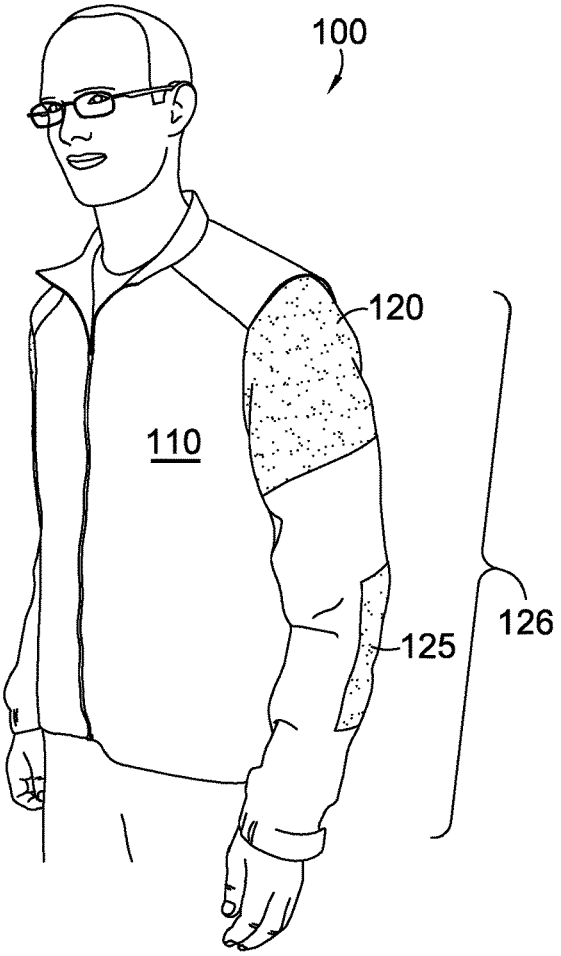
FIGS. 4-6 are different views of the exemplary jacket/coat shown in FIG. 1 as worn by an individual.
Figure 5:
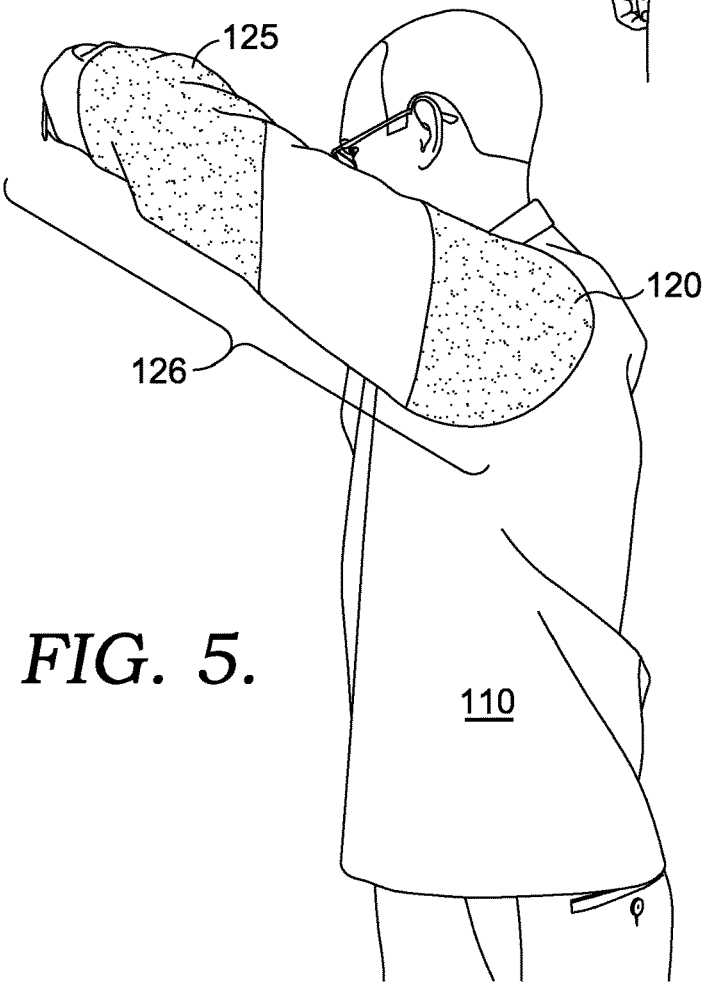
Figure 6:
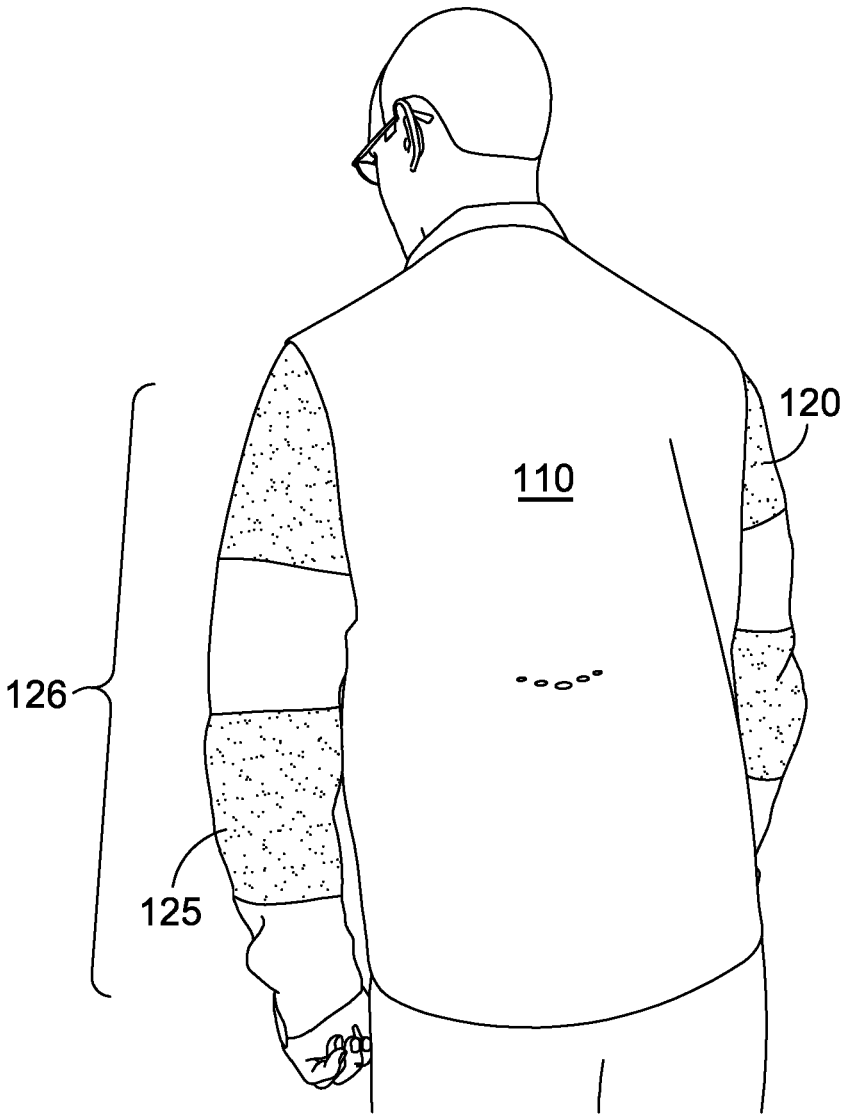

FIGS. 2 and 3 show front and back views, respectively, of the constructed jacket/coat 100 in accordance with aspects herein. FIG. 3, in particular, shows how the partial shrug portion 120 and the vest portion 110 align with each other in the jacket/coat in accordance with aspects herein. Further, FIGS. 4-6 show the jacket/coat 100 in accordance with aspects herein as worn by a user. As observed from FIGS. 4-6, the jacket/coat 100 in accordance with aspects herein provides an enhanced range of motion for the arms and back of a user by providing an elastic partial shrug portion 120 with a strain-relieving cutout 130 and, and by eliminating the shoulder and sleeve seams. Therefore, the jacket/coat construction in accordance with aspects herein, may allow the back of the garment to expand and contract as needed with any type of movement by the user.

Since the vest portion 110 of the jacket/coat in accordance with aspects herein determines the length of the jacket/coat, the vest portion may have any length desired for the particular style of jacket/coat desired. For example, the vest portion 110 may have any desired length, for example waist-length, hip-length, thigh-length, or any other length in between, or longer.

Figure 7:
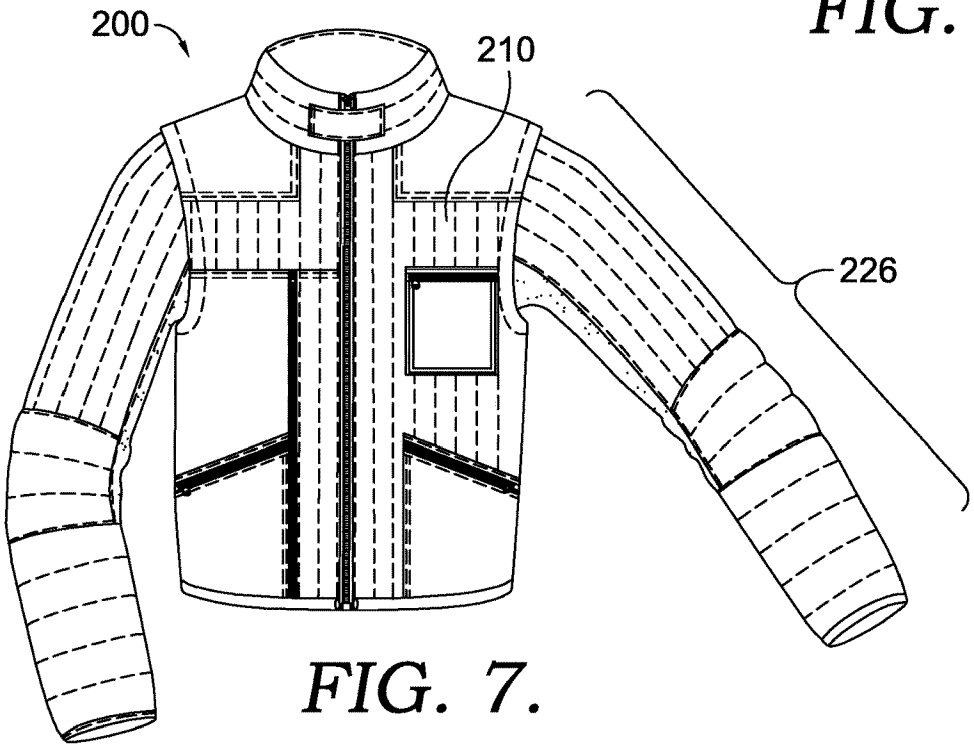
FIG. 7 is a front view of a different constructed exemplary jacket/coat in accordance with aspects herein.

In reference to FIG. 7, another example jacket/coat 200 in accordance with aspects herein is shown. As shown in FIG. 7, the jacket/coat 200 may have a vest portion 210 over a vest shrug portion 220 (not shown), with the sleeves 226 attached to it. The jacket/coat 200 may be thinly quilted with thermal fibers (synthetic or down), to provide some insulation in cold weather. Further, the outer shell of the jacket/coat 200 may be constructed from water-resistant or waterproof fabrics in combination with elastic fabrics that may or may not be waterproof.

Figure 8A:
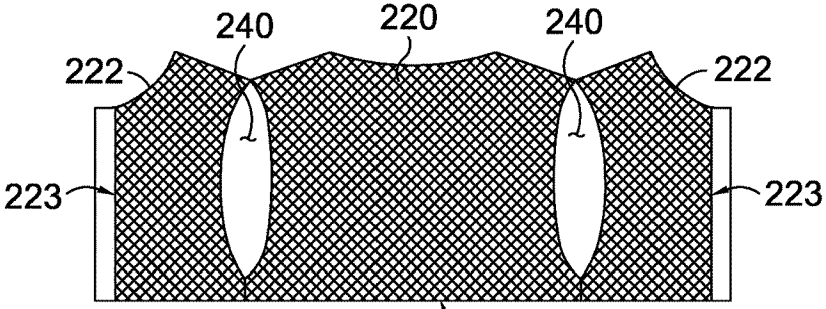
FIGS. 8A and 8B are deconstructed views of exemplary jacket/coat in FIG. 7.
Figure 8B:
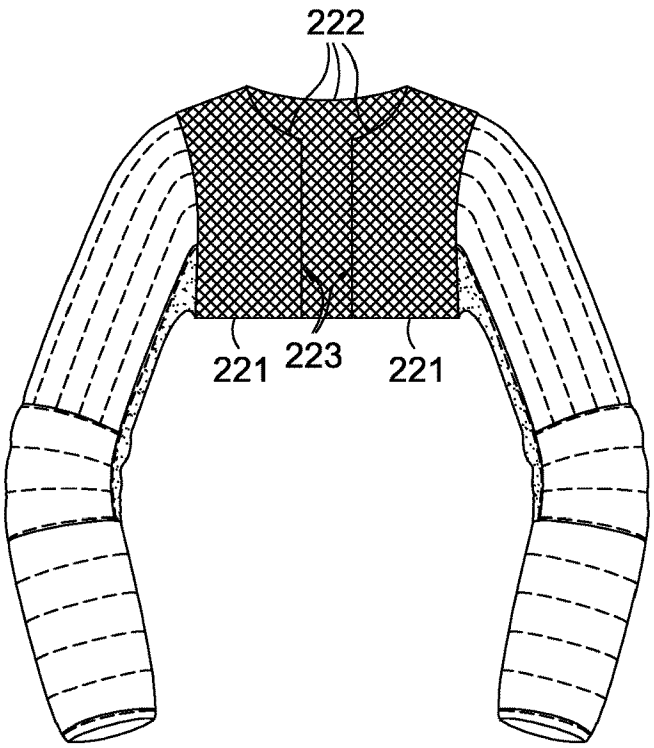

The vest shrug portion 220 is shown in FIG. 8A. The vest shrug portion 220 may comprise a resilient, yet flexible mesh-type material. The vest shrug portion 220 has two sleeve openings 240 where the sleeves 226 are attached. Further, the vest shrug portion 220 comprises a bottom edge 221, collar edges 222, and two front edges 223, which represent the points of connection with the outer vest portion 210 when the jacket/coat 200 is constructed. In FIG. 8B, the vest shrug portion 220 with sleeves 226 attached is shown. As it can be clearly seen in FIG. 8B, the sleeves 226 have the same thinly quilted construction as the vest portion 210 and thus provide the same level of insulation as the vest portion 210. Further, the sleeves 226 may comprise a flexible and stretchable fabric material under the arm extending to the elbow region to provide enhanced flexibility in this region, especially when lifting the arms and bending the elbows.

Figure 10:
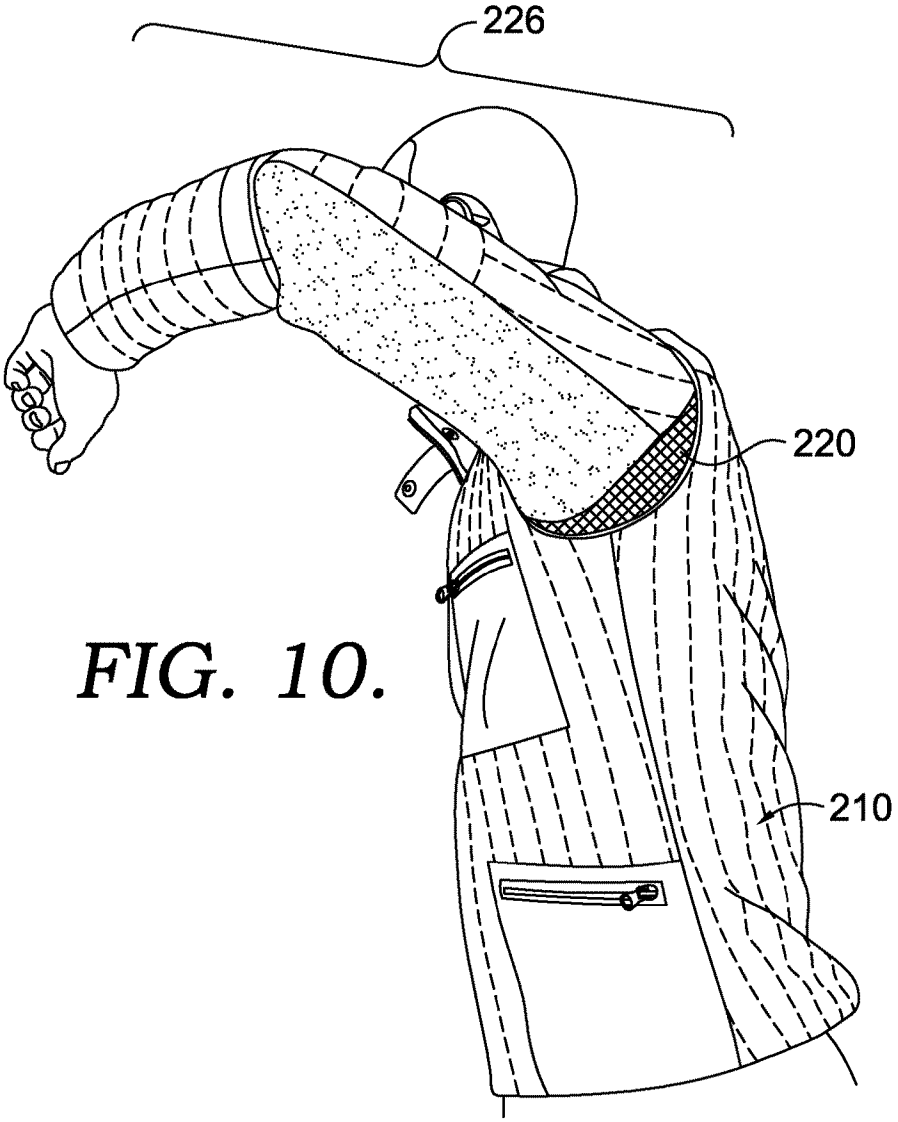
FIGS. 9 and 10 are different views of the exemplary jacket/coat shown in FIG. 7, as worn by an individual.
Figure 9:
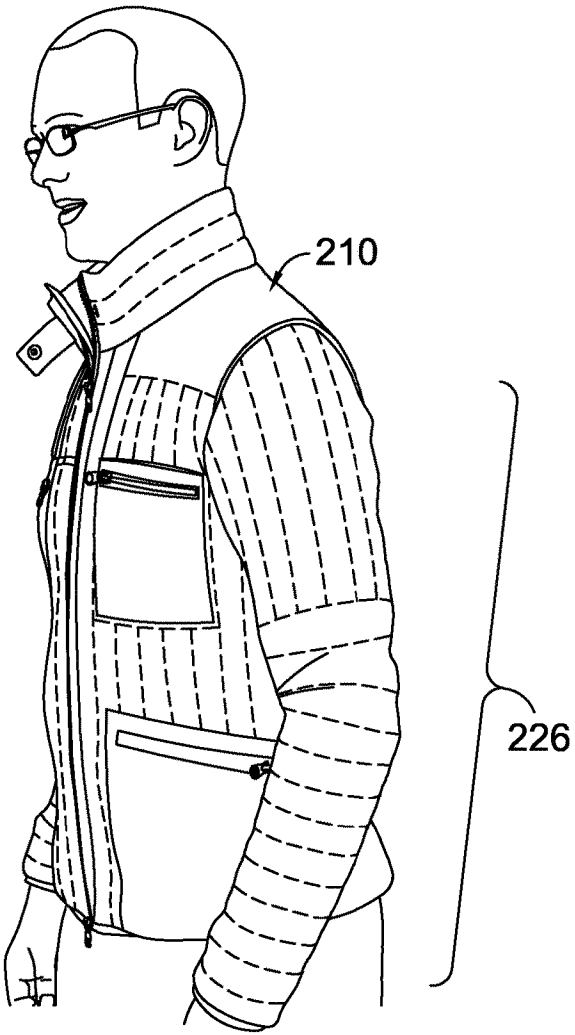

Additionally, as it can be seen in FIGS. 9 and 10, when a user is wearing the jacket/coat 200 in accordance with aspects herein, the jacket/coat 200 not only protects the wearer from cold weather, but it does not impede the range of motion for the user because there are no seams at the sleeves and shoulders between the vest shrug portion 220 and the vest portion 210. Also, because of the flexible mesh construction of the vest shrug portion 220, temperature regulation is enhanced due to the possible airflow between the inside and the outside of the jacket/coat 200.

As the jacket/coat 100 presented in FIG. 1, the length of the jacket/coat 200 in FIG. 7 is determined by the length of the vest portion 210. Thus, the vest portion 210 may be of any length desired for the particular style or need for the jacket. For example, the vest portion 210 may be waist-length, hip-length, thigh-length, knee-length, or any other length in between, or longer.

Figure 11:
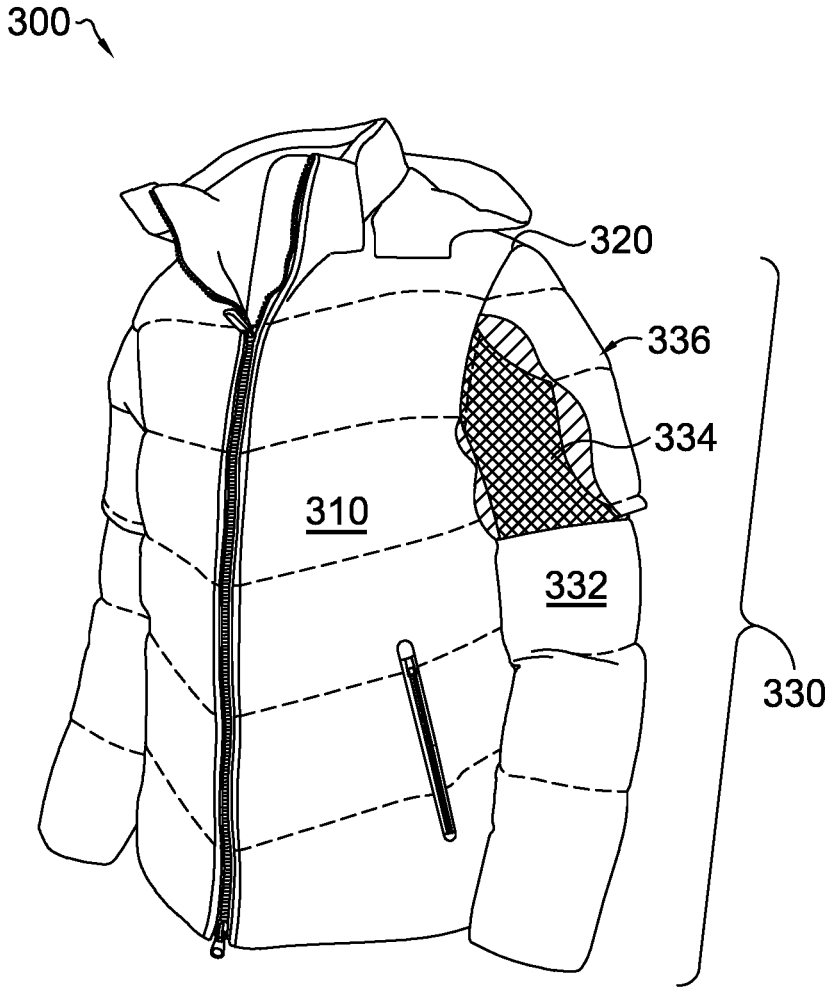
FIG. 11 is a view of a different jacket/coat in accordance with aspects herein showing the construction of the sleeve comprising a lower sleeve and an upper sleeve.
Figure 13:
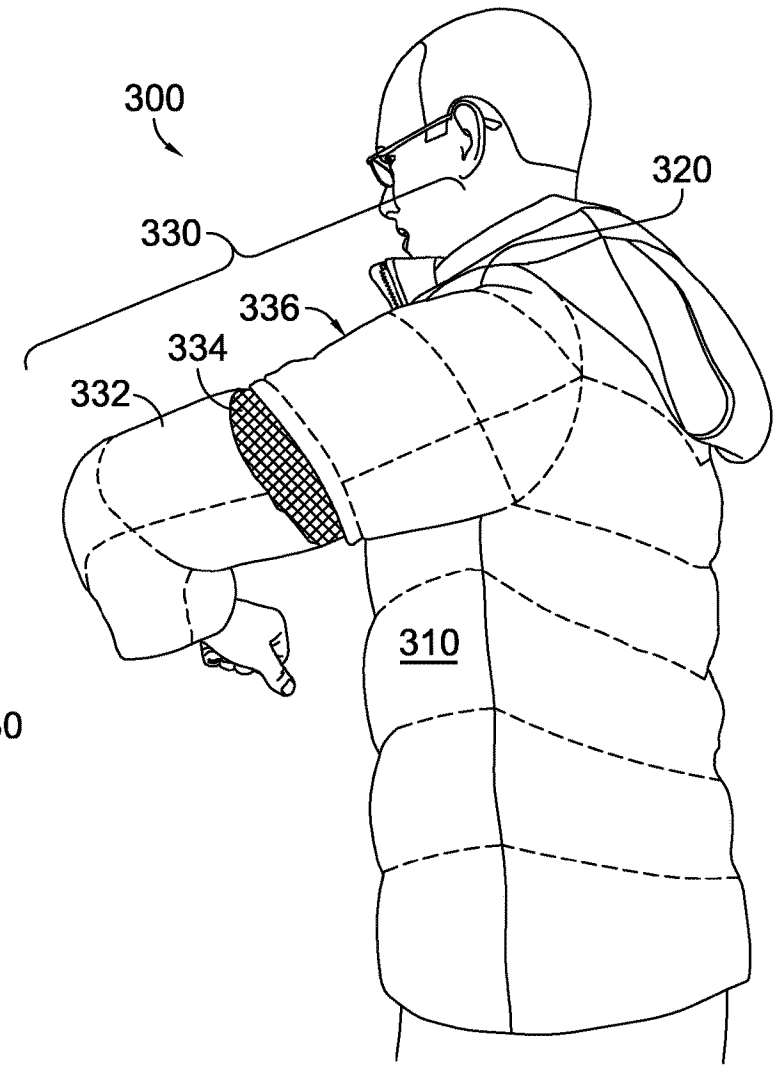
FIGS. 12 and 13 are different views of the exemplary jacket/coat shown in FIG. 11, as worn by an individual.
Figure 12:
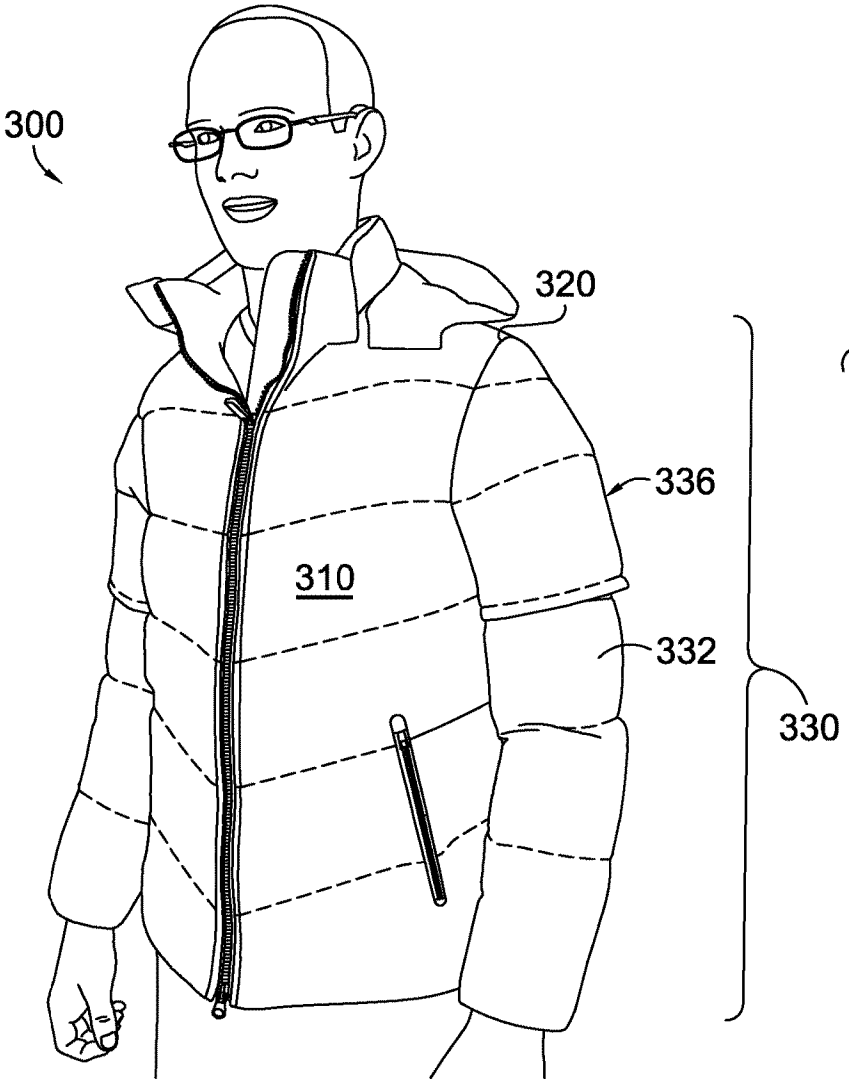

In yet a further example of the jacket/coat in accordance with aspects herein, a thick winter jacket/coat 300 is shown in FIGS. 11-13. Since winter jackets tend to be bulky for insulating against cold weather, inevitably, they may have limited breathability and, may be restrictive and not allow a user full range of motion for his/her arms and shoulders. Therefore, in the jacket/coat 300 in accordance with aspects herein, a composite sleeve 330 is provided, which may provide breathability and enhanced range of motion without compromising insulation from cold weather. In other words, the composite sleeves 330 may comprise three different sections: a lower sleeve 332, an upper sleeve 334 and a cover sleeve 336. The lower sleeve 332 may be constructed in the same way as the rest of the jacket/coat 300 using the same materials, including the insulating fibers, and may cover an arm from the wrist up to and including the elbow. Then, the upper sleeve 334 comprising a flexible and resilient mesh-type material, may be attached to the lower sleeve 332 by a seam above the elbow, and may cover the arm up to the shoulder, and be attached to the jacket/coat 300 at the seam 320 around the perimeter of the sleeve opening.

Finally, the cover sleeve 336 may also be constructed from the same materials as the rest of the jacket/coat 300, including the insulating fibers. The cover sleeve 336 may be attached to the rest of the jacket/coat 300 by a seam 320 connecting it to the sleeve opening of the jacket/coat 300. The cover sleeve 336 may extend from the shoulder to slightly below the upper sleeve 334, completely concealing the upper sleeve 334 when the arm of a user is in a rest position parallel to the user's body. It may be noted that the length ratios of the upper sleeve 334 and lower sleeve 332 may be other than the one described above. Also, the length of the cover sleeve 336 may also change accordingly, to conceal the upper sleeve 334.

FIG. 12 shows the jacket/coat 300 as worn by a person with his arms in a rest position. As it can be observed, the upper sleeve 334 of the composite sleeve 330 is completely concealed by the cover sleeve 336. FIG. 13 shows how the mesh-type material comprising the upper sleeve 334 may stretch when the wearer bends his/her arms, therefore relieving strain on the garment.

The jacket/coat 300 with the composite sleeves 330 in accordance with aspects herein, may allow for improved airflow between the inside and outside of the jacket/coat 300 and enhanced flexibility for a user due to the flexibility provided by the mesh material comprising the upper sleeve 334, keeping the user more comfortable. In other words, the composite sleeve construction in accordance with aspects herein may provide enhanced temperature regulation, as well as an enhanced range of motion for the user.

Further, just like the jackets presented above, the jacket/coat 300 in accordance with aspects herein may be of different lengths according to the style and coverage desired. For example, the jacket/coat 300 may be waist-length, hip-length, thigh-length, knee-length, or any other length in between, or longer.

Figure 16:
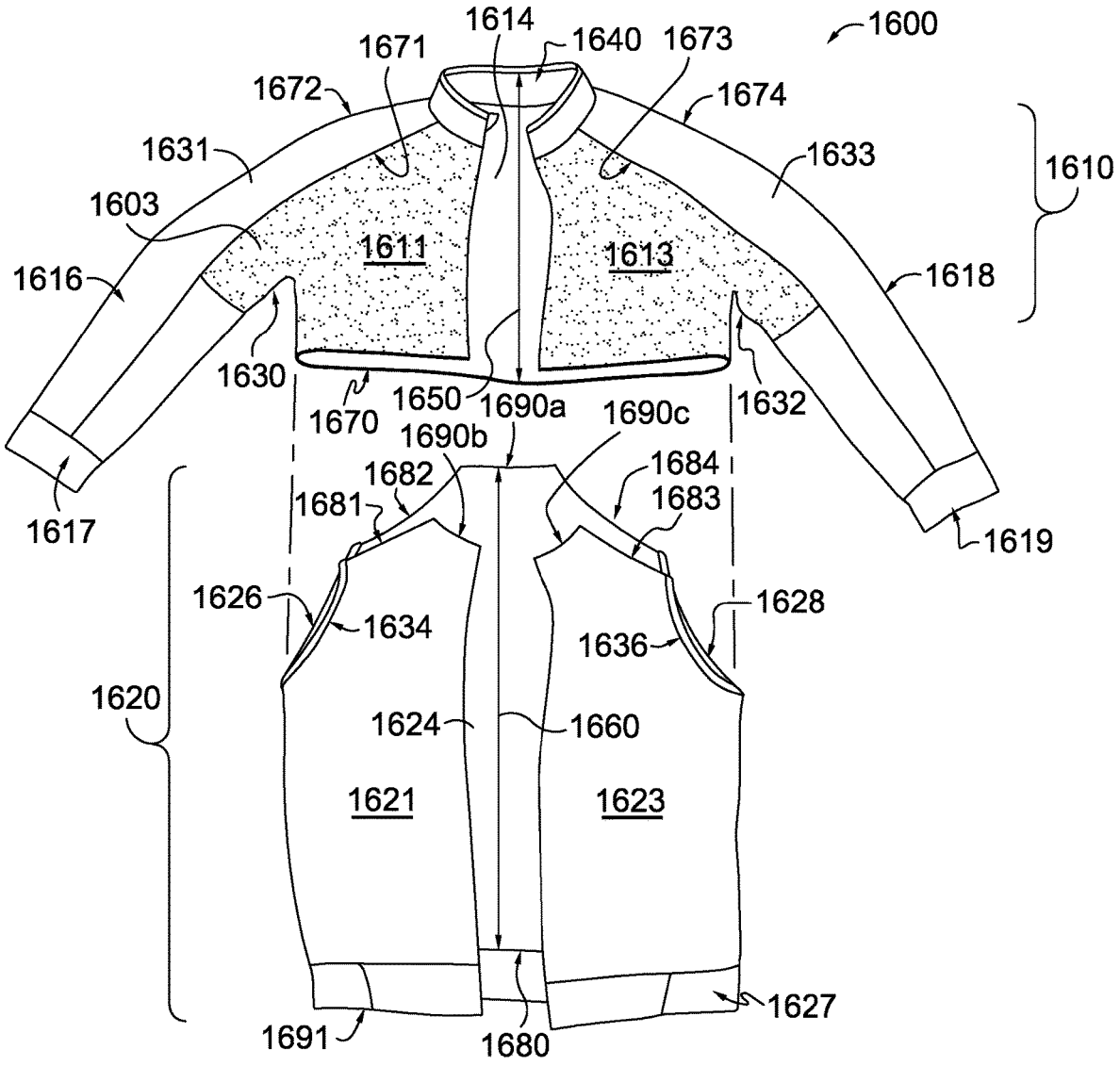
FIG. 16 is a deconstructed view of an exemplary garment in accordance with aspects herein.
Figure 17:
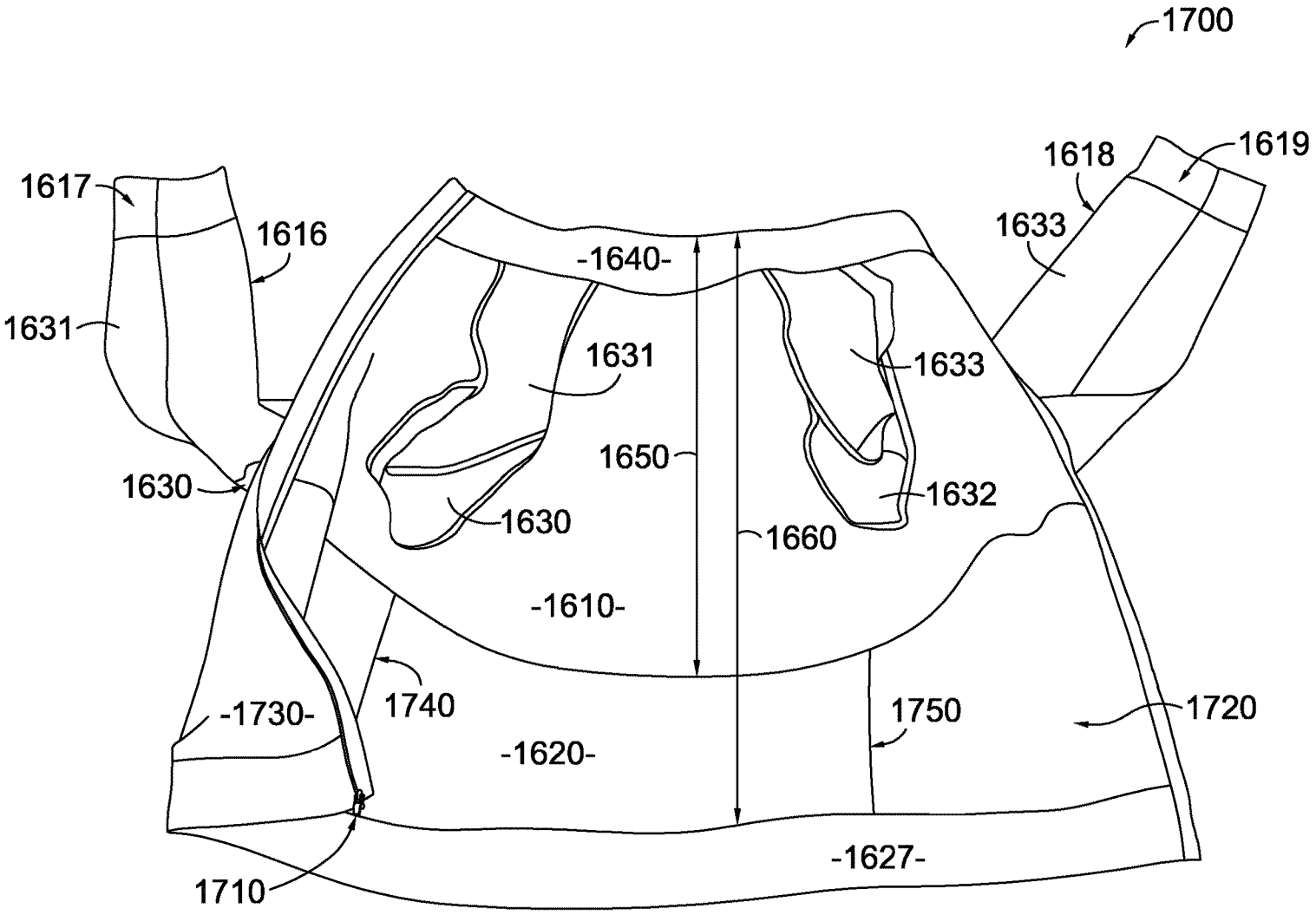
FIG. 17 is an open view of the assembled garment shown in FIG. 16 in accordance with aspects herein.

In yet a different example in accordance with aspects herein, a deconstructed view of a garment 1600 is shown in FIG. 16. Garment 1600 comprises a shrug component 1610 and a vest component 1620, where the vest component 1620 is configured to extend over or overlay the shrug component 1610. The shrug component 1610 comprises one or more front panels 1611/1613, one or more back panels 1614, and two sleeves 1616 and 1618, wherein the sleeves 1616/1618 may be long sleeves (as shown), ¾ sleeves, or short sleeves. The vest component 1620 comprises one or more front panels 1621/1623 and one or more back panels 1624. The one or more front panels 1621/1623 may be affixed to the one or more back panels 1624 at side seams 1740 and 1750 as shown in FIG. 17 to form in part two sleeve openings or partial U-shaped sleeve openings 1626 and 1628 having sleeve opening perimeters 1634 and 1636 respectively. In the alternative, the vest component 1620 may be formed from a single piece of textile material cut into the respective shape needed to form the vest component 1620 seamlessly. When the shrug component 1610 and the vest component 1620 are assembled together to form garment 1600, a right sleeve 1616 extends through the right partial U-shaped sleeve opening 1626, and the left sleeve 1618 extends through the left partial U-shaped sleeve opening 1628.

The garment 1600 is assembled by affixing front shoulder portion 1681 of the vest component 1620 to a front shoulder portion 1671 of the shrug component 1610, affixing a back shoulder portion 1682 of the vest component 1620 to a back shoulder portion 1672 of the shrug component 1610, affixing a front shoulder portion 1683 of the vest component 1620 to a front shoulder portion 1673 of the shrug component 1610, and affixing a back shoulder portion 1684 of the vest component 1620 to a back shoulder portion 1674 of the shrug component 1610. The front and back shoulder portions 1681, 1682, 1683, and 1684 of the vest component 1620 may be affixed to the front and back shoulder portions 1671, 1672, 1673, and 1674 of the shrug component 1610 by stitching, heat pressing, adhesive bonding, or any other suitable means or combination of means to form a permanent bond in accordance with aspects herein.

Further, the garment 1600 may be assembled by affixing the shrug component 1610 to the vest component 1620 at a collar portion 1640 of the shrug component 1610 and collar portions 1690 *a, b*, and *c* of the vest component 1620. The shrug component 1610 may be further affixed to vest component 1620 by affixing a bottom edge/margin 1670 of the shrug component 1610 to an interior surface of the front and back panels 1621, 1623, and 1624 of the vest component 1620 at a distance above the bottom edge/margin 1680 of the vest component 1620. To put it another way, a distance 1650 from the collar portion 1640 to the bottom edge/margin 1670 of the shrug component 1610 may be less than a distance 1660 between the collar portions 1690 *a, b*, and *c* to the bottom edge/margin 1680 of the vest component 1620. The bottom edge/margin 1670 of the shrug component 1610 may be affixed to the vest component 1620 by stitching, heat pressing, adhesive bonding, or any other suitable means, or combination of means to form a permanent bond in accordance with aspects herein.

However, in accordance with aspects herein, the bottom/inferior sleeve portions 1630 and 1632 of the shrug component 1610 are not affixed to the sleeve opening perimeters 1634 and 1636 of the vest component 1620. This allows a wearer of the garment 1600 to have full mobility when, for example, the wearer reaches his/her arms forward, backward, and/or upward. In other words, by not affixing the bottom/inferior sleeve portions 1630 and 1632 of the shrug component 1610 to the sleeve opening perimeters 1634 and 1636 of the vest component 1620, the vest component 1620 does not impede or restrain movement of the sleeves 1616/1618 of the shrug component 1610 when the garment 1600 is worn.

Figure 18:
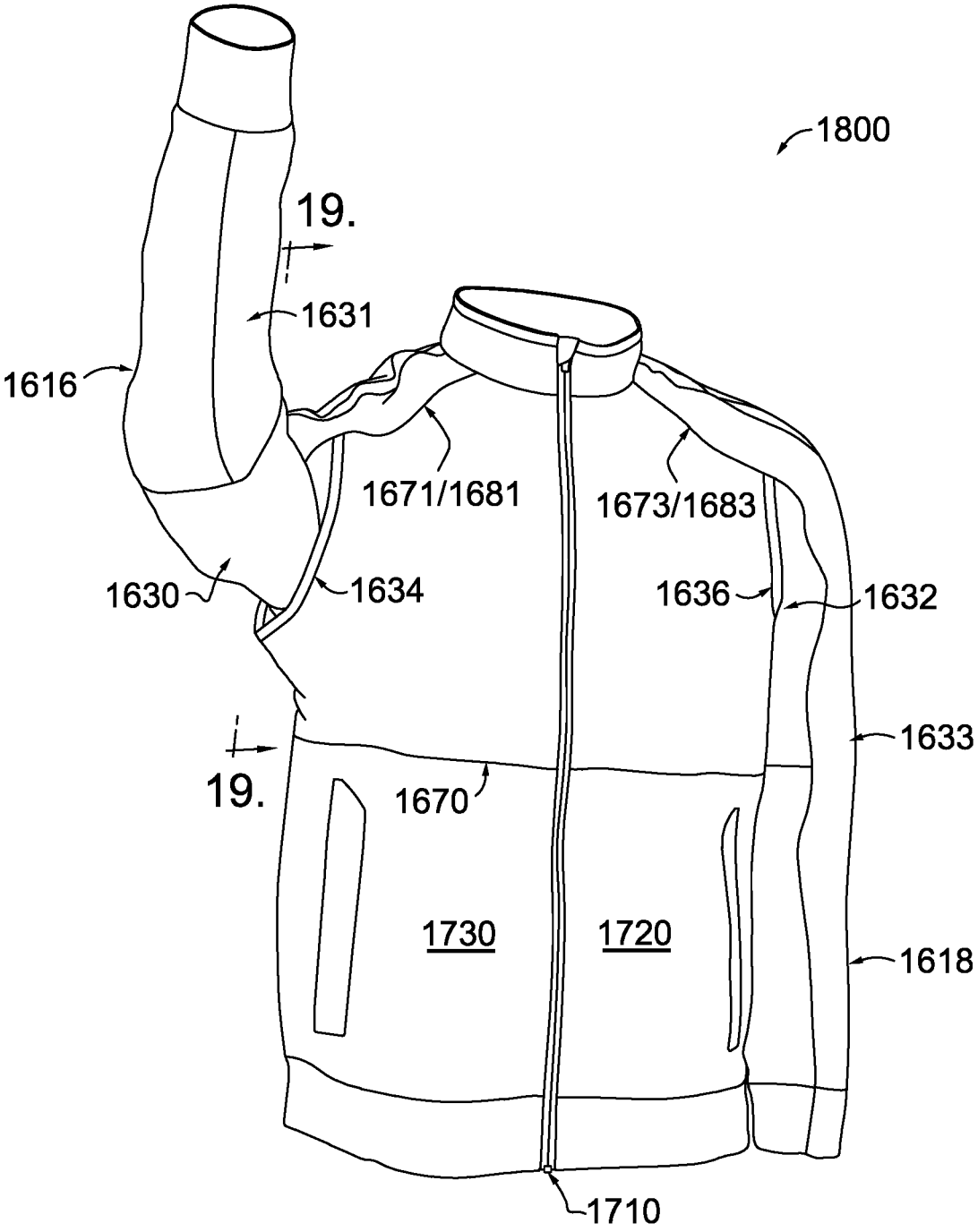
FIG. 18 is a closed view of the assembled garment shown in FIGS. 16 and 17 in accordance with aspects herein.

In embodiments in accordance with aspects herein where the garment 1600 is a front opening jacket (as shown in FIGS. 16-18), the shrug component 1610 may further be affixed to the vest component 1620 at a location where a closing mechanism extending from the collar 1640/1690 to the bottom edge/margin 1680, or a garment bottom edge 1691 of the vest component 1620, is provided. As shown in FIG. 17, the closing mechanism 1710 may serve to releasably affix the front right panel 1730 of the garment 1600 to the left front panel 1720 of the garment 1600. The closing mechanism 1710 may comprise for example, a zipper, buttons, hook-and-loop type mechanisms, or any other suitable means for providing an easy open and close function to the garment 1600.

In exemplary aspects, the shrug component 1610 may comprise a first textile material that is more elastic than a second textile material comprising the vest component 1620. For example, the shrug component 1610 may comprise elastane, Lycra®, elastic polyester, elastic nylon, or any other suitable textile material, in accordance with aspects herein. The vest component 1620 may comprise a material that is less elastic than the shrug component 1610. The vest component may comprise natural and/or synthetic fibers such as cotton, hemp, bamboo, polyester, nylon, plastic, thermoplastic polyurethane, or any other suitable material. The material of the vest component may be a material that is treated to be or is naturally waterproof, water resistant, and/or water repellent. Further, the sleeves 1616/1618 of the shrug component 1610 may comprise the same textile material as the shrug component 1610, the same textile material as the vest component 1620, or in the alternative, the sleeves 1616/1618 may comprise sleeve portions of the first textile material of the shrug component 1610 (where higher elasticity would be advantageous for better comfort and higher range of mobility), and other sleeve portions of the second textile material of the vest component 1620 (where the properties of the textile material of the vest component 1620 would be more desirable, such as the forearm portion of the sleeves in a long sleeve embodiment, as shown). For example, superior sleeve portions 1631/1633 of the shrug component 1610 may comprise the second textile material of the vest component 1620 and inferior sleeve portions 1630/1632 of the shrug component 1610 may comprise the first textile material of the shrug component 1610. Additionally, the sleeves 1616/1618 may comprise additional structural, functional, and/or decorative features to complement the garment 1600.

In different aspects in accordance with the garment 1600, the shrug component 1610 may comprise a first material having a first color, the first material having a first elasticity. The first color of the first material may be a single color, a combination of colors, a patterned textile material, a textile material having different designs such as a team logo, favorite character, landscape, etc. The vest component 1620 may comprise a second material having a second color, the second material having a second elasticity. The second color of the second material may be a single color, a combination of colors, a patterned textile material, a textile material having different designs, etc. The second textile material may or may not be transparent or see-through. If see-through, a design/pattern on the vest component 1620 may be configured to be complementary to a design/pattern on the shrug component 1610.

The garment 1600 may be a long jacket (extending substantially below the waistline of a wearer when worn), a short jacket (extending above the waistline of a wearer when worn), or a waist length jacket (extending around the waistline of a wearer when worn), as shown. The garment 1600 may further comprise cuffs 1617 and 1619 and a waistband 1627 of a third material, wherein the third material comprises an elasticity that is greater than or equal to the elasticity of the first material forming the shrug component 1610. The cuffs 1617/1619 and the waistband 1627 may aid in providing a comfortable fit of the garment 1600 when the jacket is worn. For example, the cuffs 1617/1619 and the waistband 1627 may aid in keeping the garment in place, as desired by the wearer, when the jacket is worn.

FIG. 17 shows an open configuration 1700 of the garment 1600 in accordance with aspects herein. As described above, superior sleeve portions 1631/1633 of sleeves 1616/1618 of the shrug component 1610 may comprise a material that is equal to or similar to the material of the vest component 1620, and the material of inferior sleeve portions 1630/1632 may comprise a material that is the same as or similar to the material of the shrug component 1610, where the material of the shrug component 1610 is more elastic than the material of the vest component 1620.

FIG. 18 shows a closed configuration 1800 of the garment 1600 in accordance with aspects herein. As seen in FIG. 18, the vest component 1620 and the shrug component 1610 are affixed at the front shoulder portions 1671/1681 and the back shoulder portions 1672/1682 (not shown) of the vest component 1620 and the shrug component 1610, but the inferior sleeve portions 1630/1632 of the shrug component 1610 are not affixed to the arm hole perimeter portions 1634/1636 of the vest component. This feature of aspects herein is described in more detail below in relationship to FIG. 19.

Figure 19:
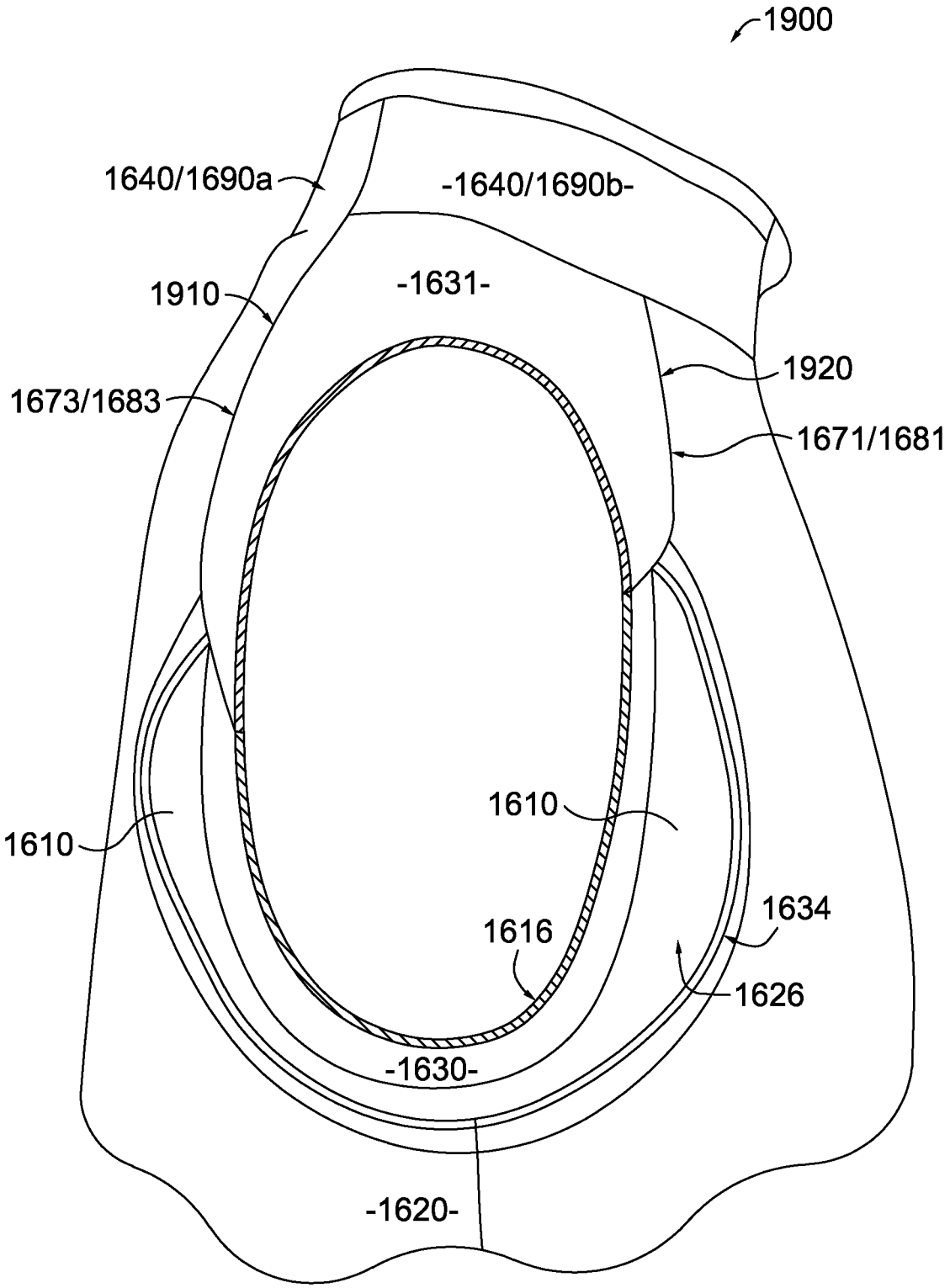
FIG. 19 is a cross-sectional view of the garment shown in FIG. 18 along the line 19-19 in accordance with aspects herein.

FIG. 19 is a cross section along the line 19-19 in FIG. 18 in accordance with aspects herein. As seen in more detail in FIG. 19, the right sleeve 1616 of the shrug component 1610 comprises a superior sleeve portion 1631 and a bottom/inferior sleeve portion 1630. The vest component 1620, as described above, is fixedly or permanently attached at front shoulder portions 1671/1681 and back shoulder portions 1673/1683 of the shrug component 1610 and the vest component 1620. The attachment points or area on the front shoulder portions 1671/1681 and back shoulder portions 1673/1683 may be defined by a back seam 1910 and a front seam 1920. Further, in accordance with aspects herein, in FIG. 19 it can be seen that the superior sleeve portion 1631 is depicted as a single layer of material, and the vest component 1620 forms a partial U-shaped sleeve opening 1626 that has a sleeve opening perimeter 1634 as defined by the front panel 1621 and the back panel 1624 of the vest component 1620, where the bottom/inferior sleeve portion 1630 of the shrug component 1610 is not attached to the sleeve opening perimeter 1634 of the partial U-shaped sleeve opening 1626 of the vest component 1620. The superior sleeve portion 1631 of the shrug component 1610, however, is shared with the vest component 1620 when the garment 1600 is assembled. Similarly, as described above, the left sleeve 1618 may be constructed in the same way as the right sleeve, forming a sleeve opening perimeter 1636 as defined by the front panel 1623 and the back panel 1624 of the vest component 1620, where the bottom/inferior sleeve portion 1632 of the shrug component 1610 is not attached to the sleeve opening perimeter 1636. In a different embodiment in accordance with aspects herein (not shown,) the vest component may comprise a full sleeve opening, defined by an enclosed perimeter, where the shrug component and the vest component may be attached along a top shoulder seam of both the vest component and the shrug component, and detached at remainder portions of the sleeve opening perimeter of the vest component and sleeve portions of the shrug component.

Although garment 1600 is depicted in FIGS. 16-19 as being an openable jacket with a front zipper, the garment 1600 may be a pullover garment with a crew neck, V-neck, or a zippered collar, a hoodie, a t-shirt, a shirt type, or any other type of garment that would benefit from the improved range of motion provided by the configuration of garment 1600 described herein.

Figure 20:
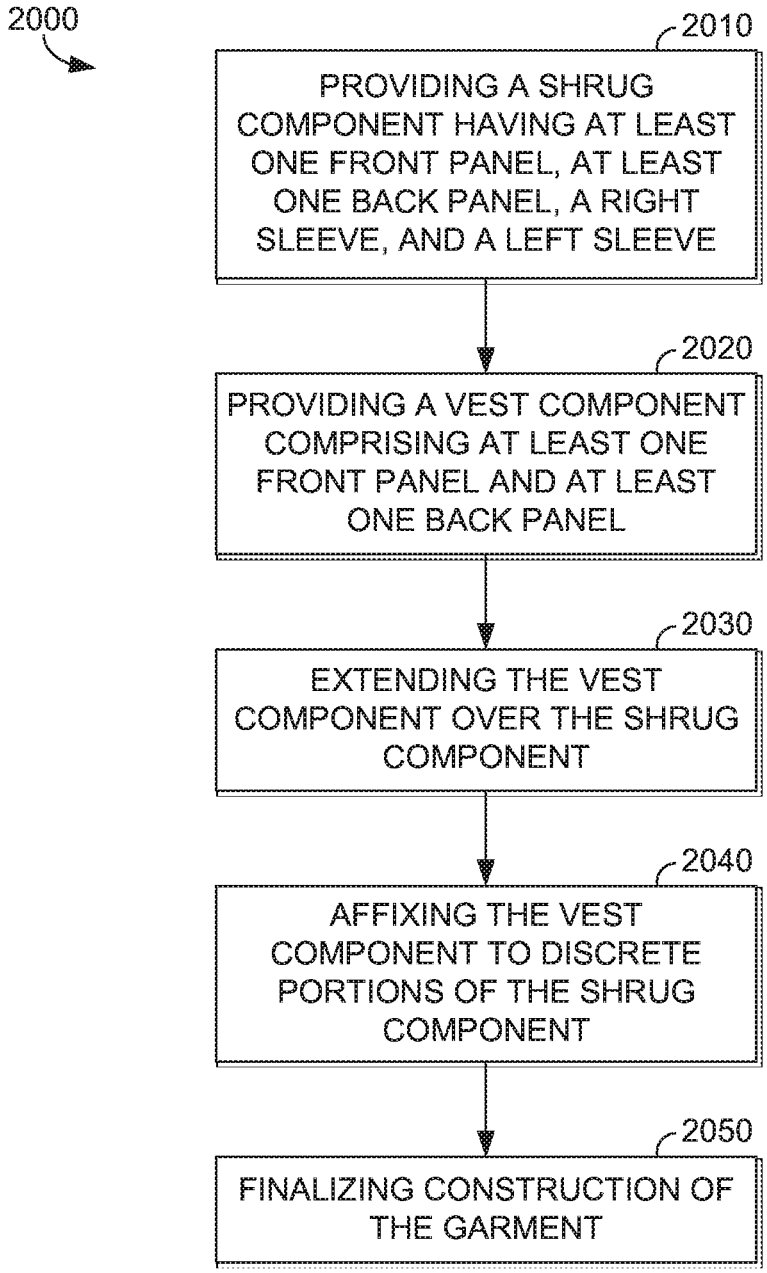
FIG. 20 is a flow chart of an exemplary method of manufacturing the garment shown in FIGS. 16-19.

FIG. 20 depicts a flow chart outlining a method 2000 for manufacturing a garment, such as the garment 1600 shown in FIGS. 16-19 in accordance with aspects herein. The method 2000 starts by the step 2010 of providing a shrug component of a first material, which depending on the configuration of the garment, may comprise, one or more front panels, one or more back panels, a right sleeve, and a left sleeve. The sleeves may be formed continuously with the one or more front and back panels, or may be formed from separate panels attached to the shrug component by seams. The seams for forming the shrug component may be formed by stitching, adhesive bonding, heat pressing, or any other suitable method for forming seams in a garment. The sleeves of the shrug component may comprise the same material of the shrug component, or in the alternative, may comprise two or more materials with different physical properties. Next, the method comprises the step 2020 of providing a vest component of a second material, which depending on the configuration of the garment, may comprise, one or more front panels and one or more back panels that form in part a right sleeve opening and a left sleeve opening. Then, the method continues with the step 2030 of extending the vest component over the shrug component so that the right sleeve of the shrug component extends through the right sleeve opening of the vest component and the left sleeve of the shrug component extends through the left sleeve opening of the vest component. Subsequently, the method continues with the step 2040 of assembling the garment by affixing the vest component to discrete portions of the shrug component while not affixing the shrug component to the vest component at inferior sleeve portions of the shrug component. And, construction of the garment is finalized at step 2050 by providing finishing touches to the garment such as cuffs, waistbands, and zippers.

Figure 21:
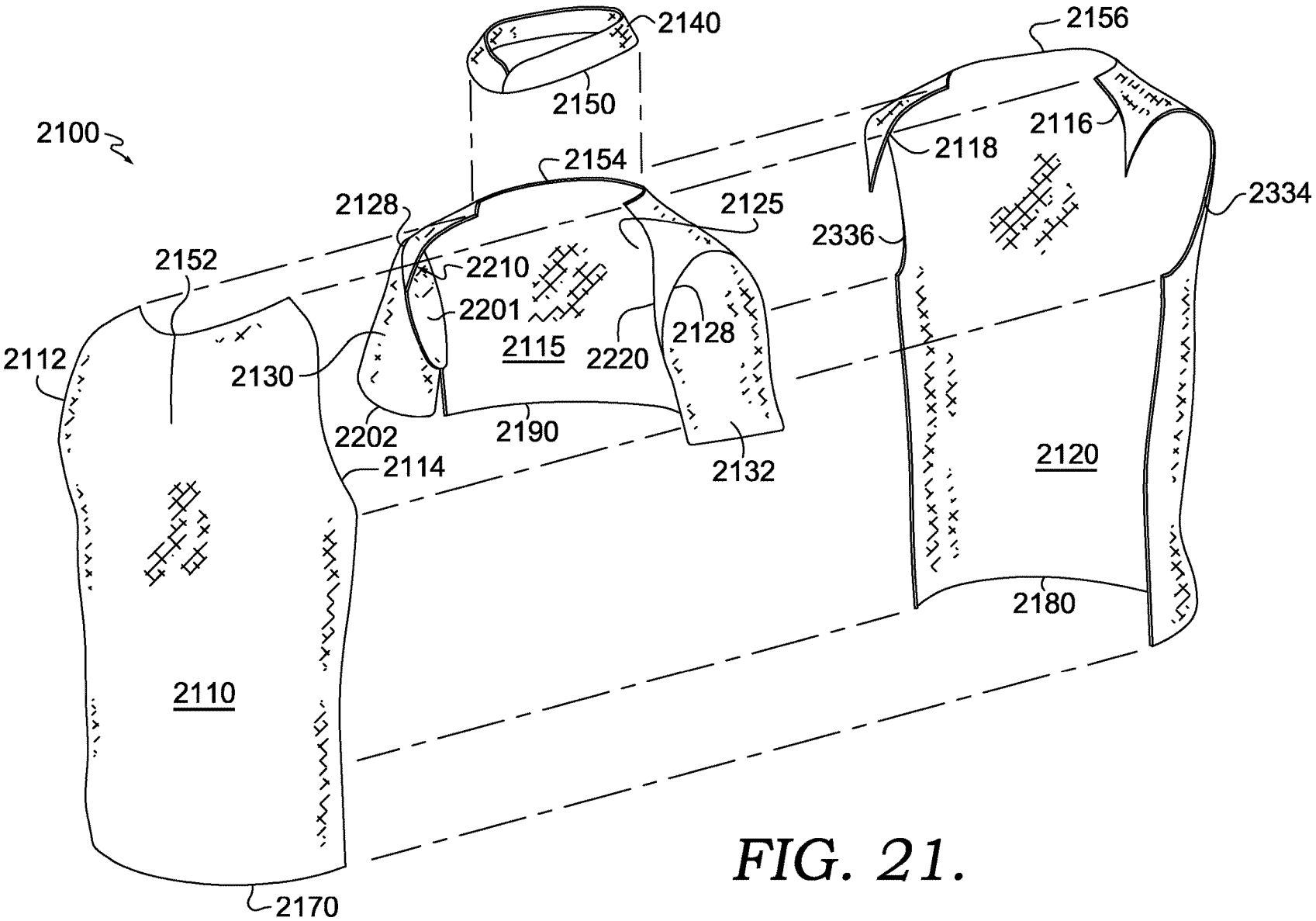
FIG. 21 is a front perspective view of an exemplary garment in accordance with aspects herein.

In yet another example in accordance with aspects herein, a deconstructed view of a garment 2100 is shown in FIG. 21. Garment 2100 comprises an interior component/portion 2115 and an exterior component/portion 2310 in FIG. 23, comprising front panel 2110 and back panel 2120 where the exterior component/portion. 2310 is configured to extend over or overlay the interior component/portion 21.15. The interior component/portion 2115 comprises at least one or more back panels 2125, and two sleeves 2130 and 2132, wherein the sleeves 2130/2132 may be, for example, long sleeves, ¾ sleeves, short sleeves (as shown), or any other length desired for the garment 2100. Each sleeve 2130 and 2132 comprises an upper sleeve opening 2201 and a lower sleeve opening 2202, where the upper sleeve opening is defined, in part, by respective front edges 2210 and 2220 (better seen in FIG. 22). The exterior component/portion 2310 comprises one or more front panels 2110 having a bottom edge 2170 and one or more back panels 2120 having a bottom edge 2180. The one or more front panels 2110 may be affixed to the one ormore back panels 2120 at garment forming seams 2320 as shown in FIG. 23, to form, in part, two sleeve openings 2330 and 2332, where the sleeve opening 2330 is defined, in part, by front edge 2114 and sleeve opening perimeter 2334 and the sleeve opening 2332 is defined, in part, by front edge 2112 and sleeve opening perimeter 2336. In the alternative, the exterior component/portion 2310 may be formed from a single piece of textile material formed into the respective shape needed to form the exterior component/portion 2310 seamlessly. When the interior component/portion. 2115 and the exterior component/portion 2310 are assembled together to form garment 2100, the sleeve 2130 of the interior component/portion 2115 extends through the sleeve opening 2332 of the exterior component/portion 2310, and the sleeve 2132 of the interior component/portion 2115 extends through the sleeve opening 2330 of the exterior component/portion 2310.

Figure 22:
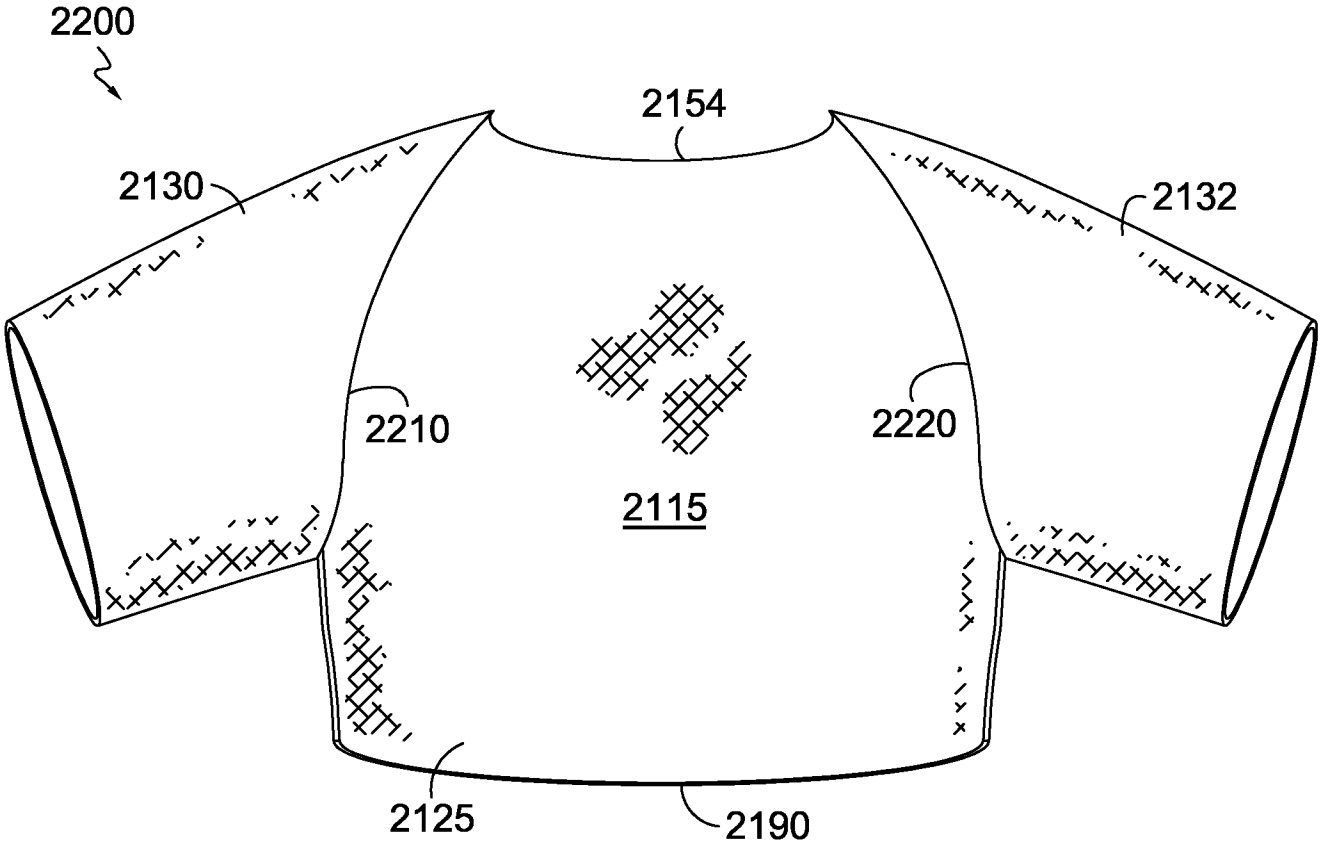
FIG. 22 is a back perspective view of the exemplary garment shown in FIG. 21.
Figure 23:
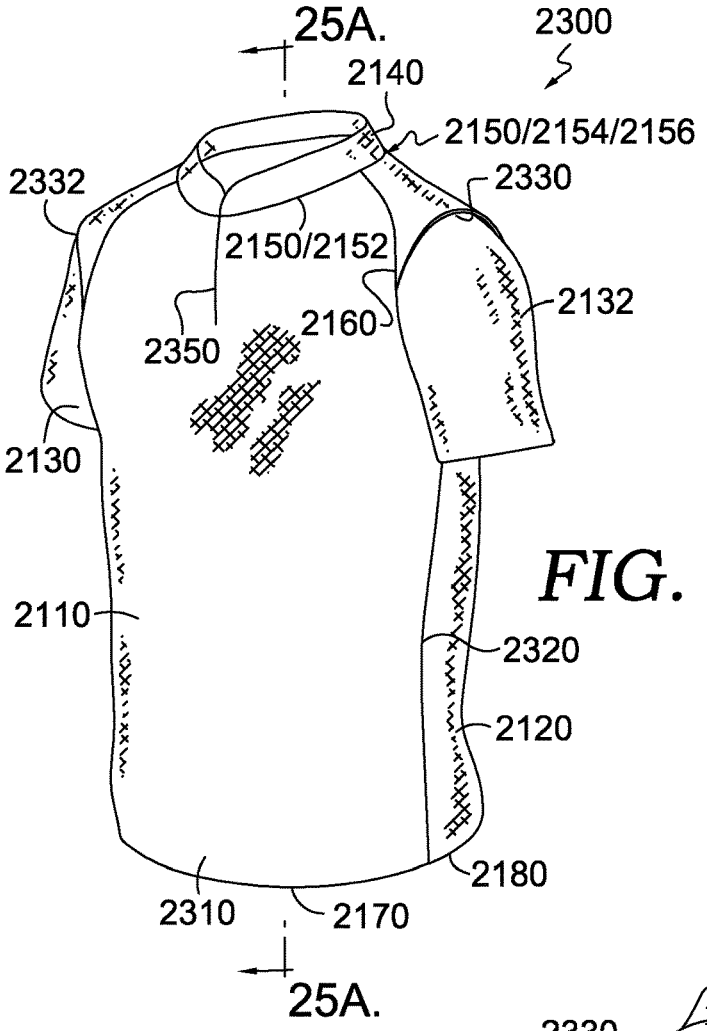
FIG. 23 is a exploded view of the exemplary garment shown in FIGS. 21 and 22.

With reference to FIG. 22, which is a front view 2200 of the interior component/portion 2115, as shown, the interior component/portion 2115 comprises a back panel 2125 and two sleeves 2130 and 2132. The interior component/portion 2115 may not comprise a front panel(s) in one aspect although it is contemplated herein that the interior component/portion 2115 may comprise a front panel(s). Each of the sleeves 2130 and 2132 comprise front edges 2210 and 2220, respectively. The sleeves 2130 and 2132 may be continuous (seamlessly adjacent) with the back panel 2125 (not shown), or may be attached or joined (affixed by permanently stitching, bonding, welding, and the like) to the back panel 2125 by seams 2128 (as shown in FIG. 21). If the sleeves 2130/2132 are attached, the sleeves 2130/2132 may comprise the same material(s) as the back panel 2125, or the sleeves 2130/2132 may comprise a different material(s) than the back panel 2125. If a different material(s) is used, it may be used to enhance the properties of the garment such as, for example, stretchability, breathability, color scheme, visual patterns, and the like. For example, the interior component/portion 2115 may comprise a first material that is light weight and stretchable. In exemplary aspects, the first material may be a stretch knit fabric having a first modulus of elasticity. The stretchability may be achieved by employing elastic fibers (e.g. polyurethane, elastane, Lycra®, Spandex®) in combination with natural fibers (e.g. cotton, hemp, silk) and/or synthetic fibers (e.g. rayon, polyester). The first material may further comprise moisture management properties that work to pull moisture away from a wearer to impart a longer dry feeling to the wearer, as opposed to when, for example, conventional materials such as cotton are employed.

Referring to the exterior component/portion 2310 as seen in FIG. 23, the exterior component/portion 2310 may comprise different materials than that of the interior component/portion 2115. For example, the exterior component/portion 2310 may be formed from stretch woven fabrics/textiles. The stretch woven fabrics/textiles may have a different modulus of elasticity than the interior component/portion 2115. For instance, the modulus of elasticity of the exterior component/portion 2310 may be greater than the modulus of elasticity than the interior component/portion 2115, meaning that the interior component/portion 2115 is generally more stretchable (stretches to a greater extent) than the exterior component/portion 2310.

Further, because woven fabrics tend to hold less moisture than knit fabrics due to the tighter weave construction, the stretch woven textile/fabric may generally have a tendency to have faster drying times than a stretch knit fabric, which further enhances the rapid evaporation of moisture transported, for example, from the wearer's body to the stretch knit back panel 2125 of the interior component/portion 2115 and to the stretch woven back panel 2120 of the exterior component/portion 2310. Additionally, by virtue of their woven pattern, stretch woven textiles/fabrics tend to be less sheer than stretch knit textiles/fabrics. In further aspects, in order to further enhance breathability, the stretch woven textile/fabric may comprise a plurality of openings 2430 that are integrally formed in the weaving process, or alternatively, the plurality of openings 2430 may be formed post weaving, such as by laser cutting, die cutting, and the like. The plurality of openings 2430, when present, may further aid in the evaporative elimination of moisture from perspiration when the garment is worn. The plurality of openings 2430 may be located in different areas of the garment where deemed appropriate for functional and/or aesthetics of the garment. For example, the plurality of openings 2430 may be located along an upper portion of the back panel 2120 of the exterior component/portion 2310, above the bottom edge/margin 2190 of the interior component/portion 2115, or any other areas of the garment 2100 configured to align with high heat producing areas of the wearer's body when the garment is worn.

Furthermore, the materials for the at least one front panel 2110 and the at least one back panel 2120 may further be differentiated to enhance the overall properties of the garment such as, for example, stretchability, breathability, color scheme, visual patterns, and the like. For example, the at least one front panel 2110 of the exterior component/portion 2310 may comprise a first light weight stretch woven material comprising moisture management properties as well as UV radiation blocking properties. The at least one back panel 2120 may comprise a second light weight stretch woven material that is more breathable than the first material, for example, by the provision of a plurality of openings 2430, and may also comprise the moisture management and/or the UV radiation blocking properties of the first light weight stretch woven material of the at least one front panel 2110. The UV radiation blocking properties may be imparted for example, by employing textured yarns (i.e. at least partially crimped) that may have inherently or otherwise comprise UV radiation resistance properties. Other additional properties of the textured yarns may comprise, for example, moisture wicking (i.e., moisture absorbing), quick drying, light weight, and durability (e.g., good resistance to pull and/or snag). The textured yarns may also be described as bulky yarns that comprise more air pockets than conventional yarns, which may also contribute to their faster drying times. A textured yarn may be employed in the weaving process of the first and/or the second stretch woven material. Alternatively, the UV radiation blocking and/or the moisture management properties may be imparted to the at least one front panel 2110 and the at least one back panel 2120 of the exterior component/portion 2310 by, for example, submitting the stretch woven materials to a chemical treatment.

Moreover, the material forming the at least one front panel 2110 may be further differentiated from the material forming the at least one back panel 2120 by changing the modulus of elasticity (having, for example, the at least one back panel 2120 having greater elasticity than the at least one front panel 2110) and/or, the at least one front panel 2110 and the at least one back panel 2120, may be aesthetically differentiated by having different colors, design patterns, weaving patterns, and the like. In an exemplary garment in accordance with aspects herein, the garment 2100 may comprise a first material for the front panel 2110 of the exterior component/portion 2310 and a second material for the back panel 2120. Further, the back panel 2125 of the interior component/portion 2115 may comprise a third material. Furthermore, the sleeves 2130 and 2132 may comprise the first material, the second material, the third material, or a different fourth material. The first, second, third, and/or fourth materials may be breathable and elastic knit or woven materials. For example, the first, second, third, and/or fourth materials may comprise elastane, Lycra®, elastic polyester, elastic nylon, or any other suitable elastic fibers in combination with natural and/or synthetic fibers such as cotton, hemp, bamboo, polyester, nylon, plastic, thermoplastic polyurethane, and the like. Additionally, the fabrics/textiles may be optionally treated to be or may be naturally waterproof, water resistant, and/or water repellent, without compromising the breathability of the stretch woven and/or stretch knit fabrics/textiles.

As described above, the interior component/portion 2115 may comprise a stretch knit material such as a stretch knit textile/fabric comprising, for example, elastane, Lycra®, elastic polyester, elastic nylon, or any other suitable elastic fibers in combination with natural and/or synthetic fibers such as cotton, hemp, bamboo, polyester, nylon, plastic, thermoplastic polyurethane, and the like. Further, the stretch knit material of the interior component/portion 2115 may be inherently more stretchable than the stretch woven material of the exterior component/portion 2310 by virtue of its knit construction. In other words, even if the same yarns were used to form the interior component/portion 2115 and the exterior component/portion 2310, the modulus of elasticity for the interior component/portion 2115 may be lower than the modulus of elasticity of the exterior component 2310 by virtue of being knit as opposed to woven. The higher stretchability of the interior component/portion 2115, in accordance with aspects herein, is advantageous because since, for example, garment 2100 is a more form fitting garment than, for example, a jacket or a coat, a greater level of stretch may be necessary across, for example, the shoulders of a wearer in order to reduce or eliminate restrictions felt by the wearer when engaged in an activity requiring freedom of movement in the shoulders and arms of a wearer (e.g. when swinging a golf club, swinging a bat, playing basketball, and the like). For the same reasons, it may also be advantageous to form the sleeves 2130 and 2132 from a stretch knit material, which may be the same stretch knit material as the interior component/portion 2115 or a different stretch knit material (e.g., different color, design pattern, more stretch fiber content, less stretch fiber content, and the like). Furthermore, the stretch knit material may inherently comprise moisture management properties based on the types of fibers/yarns used to produce the stretch knit material, or alternatively, the stretch knit material may be submitted to a chemical treatment to impart moisture management properties to the stretch knit material. The moisture management characteristics of the stretch knit material may work to efficiently transport moisture away from a wearer's body, and to impart a prolonged dry feeling to the wearer. This is advantageous because, for example, one of the surfaces of the stretch knit material forming the back panel 2125 of the interior component/portion 2115 may be a skin contacting surface, meaning that it may be in direct contact with a wearer's skin.

Figure 24:
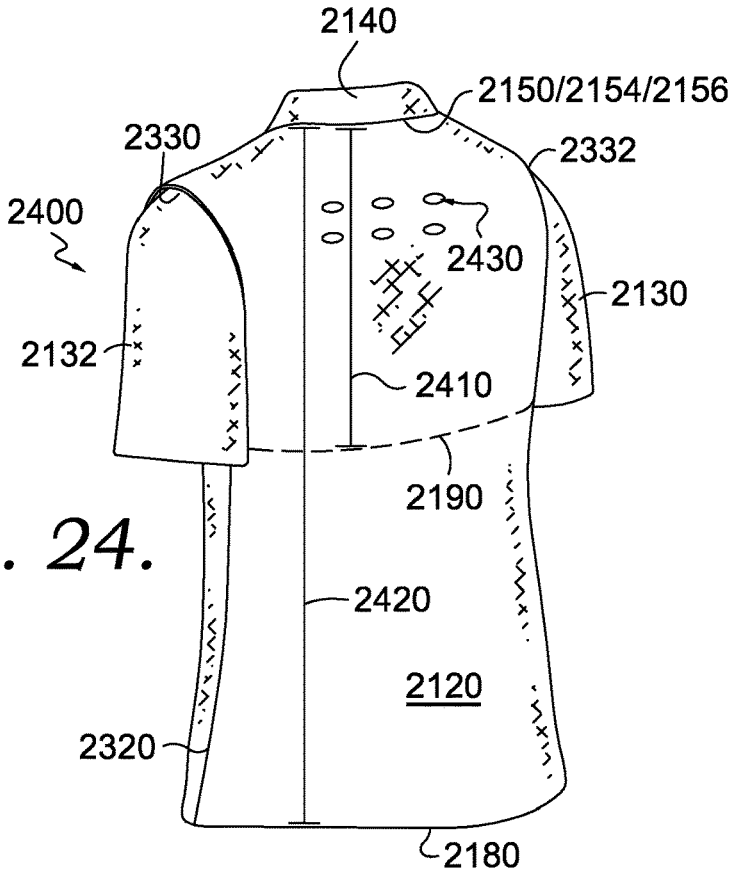
FIG. 24 is a front view of the interior component of the exemplary garment shown in FIGS. 21-23.
Figure 25A:
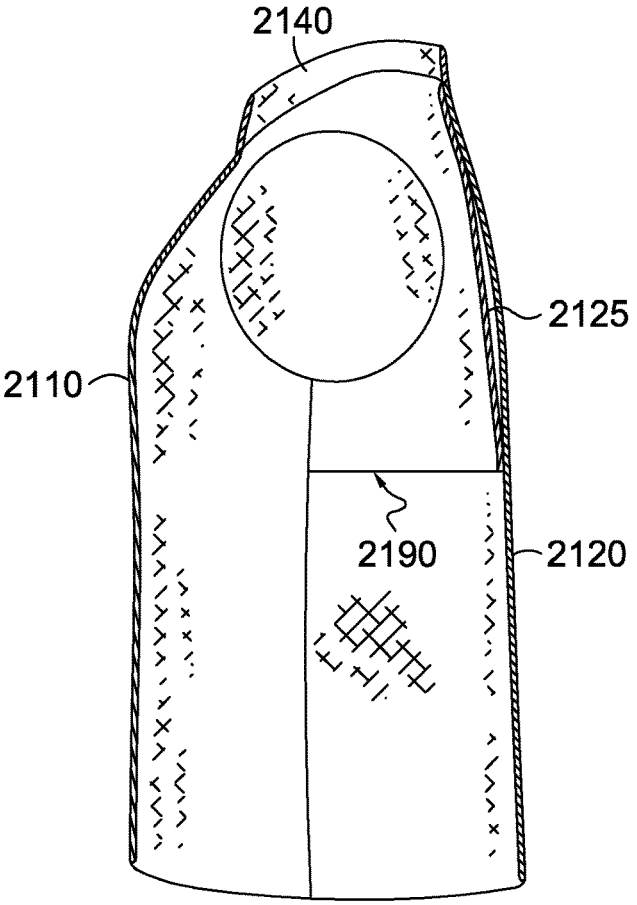
FIG. 25A is a cross-sectional view of the exemplary garment shown in FIG. 23 along the line 25A-25A.
Figure 25B:
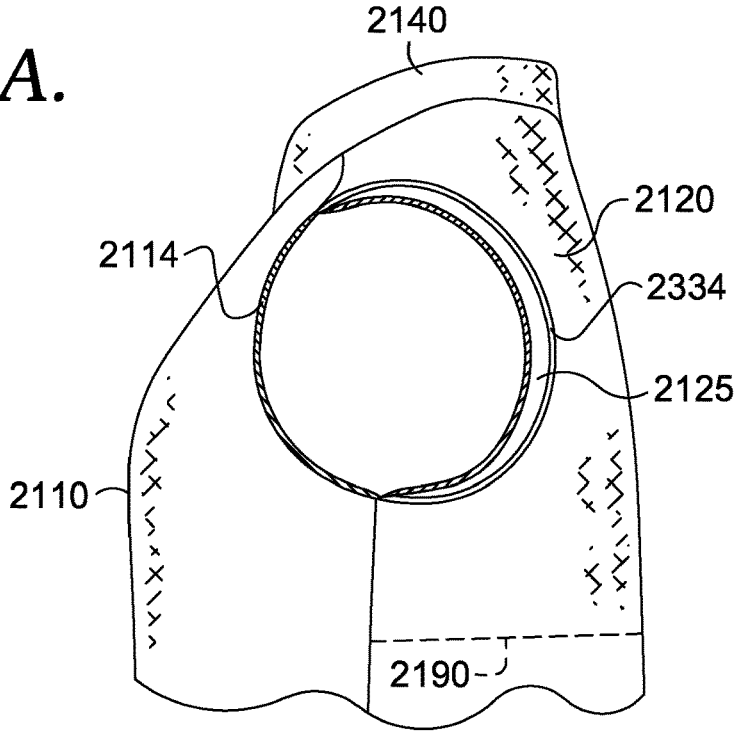
FIG. 25B is a left side lateral perspective view of the exemplary garment shown in FIG. 23 with the left sleeve removed.

The garment 2100 may be assembled by extending the sleeves 2130 and 2132 of the interior component/portion 2115 through respective sleeve openings 2330 and 2332 of exterior component/portion 2310. The front edges 2210 and 2220 of the interior component/portion 2115 may be affixed or otherwise permanently and directly bonded to only the front edges 2112 and 2114 of the respective sleeve openings 2330 and 2332 of the exterior component/portion 2310, at edge 2160, as shown in FIG. 23. This results in sleeve opening perimeters 2334 and 2336 of sleeve openings 2330 and 2332 of the exterior component/portion 2310 being fully detached from remaining portions of the sleeves 2130/2132 of the interior component/portion 2115, as shown in the front perspective view 2300 of garment 2100 and the back perspective view 2400 of the garment 2100 in FIGS. 23 and 24, and the side perspective view of FIGS. 25A and 25B, where FIG. 25A shows a cross-sectional view of garment 2100 along the line 25A-25A in FIG. 23, and where FIG. 25B shows a partial perspective of garment 2100 with a cross-sectional view of the sleeve 2132 at the sleeve opening perimeter 2334. Although garment 2100 is shown as a short-sleeved polo style garment, one of ordinary skill in the art will recognize that this is an exemplary gannent type and many other possibilities are possible by changing, for example, the sleeve length, removing the closable opening, extending the length of the closable opening, changing the type of collar provided, and the like.

Figure 26:
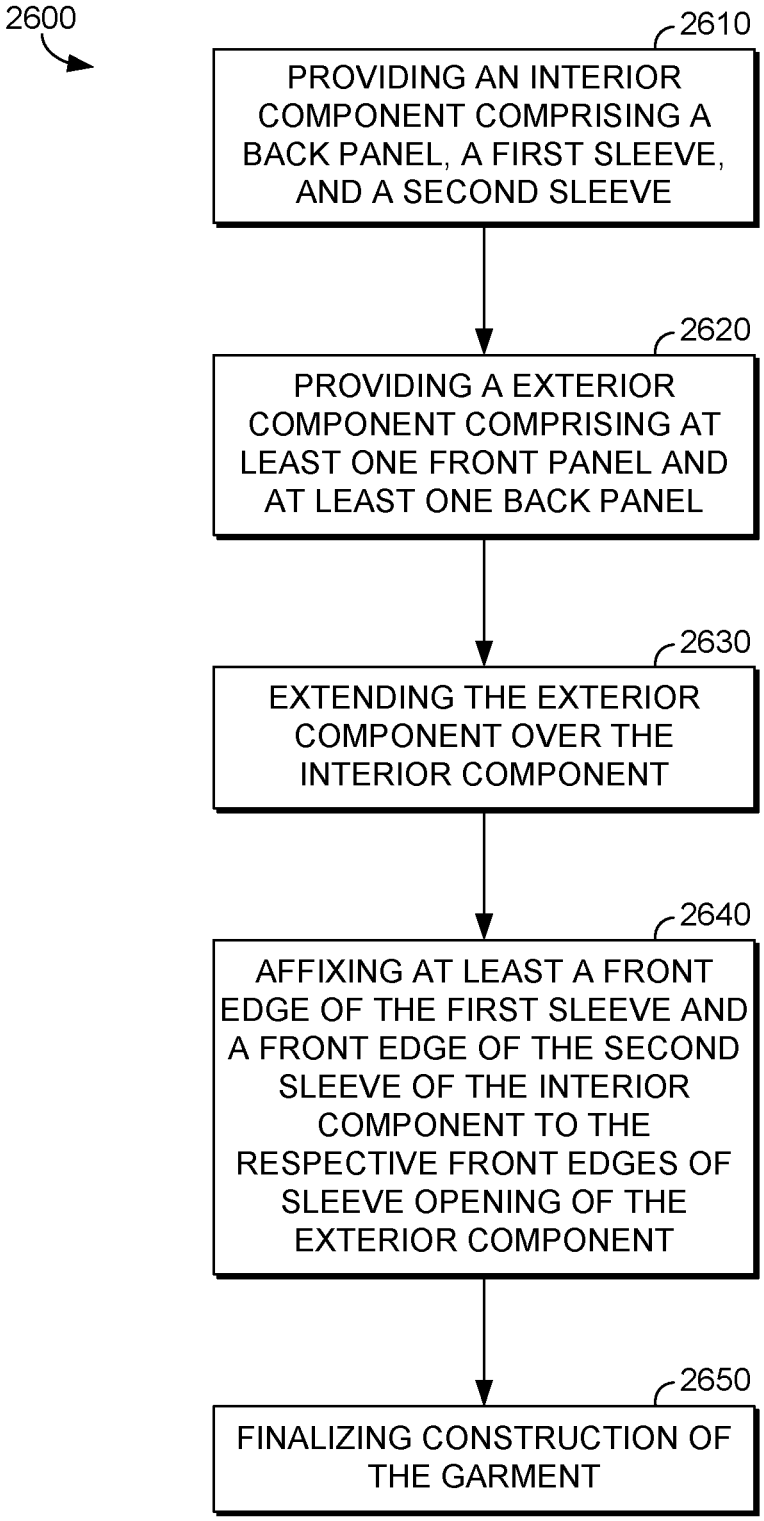
FIG. 26 is a flow chart of an exemplary method of manufacturing a garment shown in FIGS. 21-25B.

The interior component/portion 2115 may be further affixed to the exterior component/portion 2310 at a collar edge 2154 of the interior component/portion 2115 and a collar edge 2156/2152 of the exterior component/portion 2310 by, for example, stitching, heat pressing, adhesive bonding, or any other suitable means or combination of means to form a permanent bond in accordance with aspects herein. Depending on the garment style, a collar 2140 may be further attached to the assembled garment 2100 by permanently bonding, sewing, and the like a collar edge 2150 of the collar 2140, as shown. Furthermore, the interior component/portion 2115 may be further affixed to the exterior component/portion 2310 by affixing a bottom edge/margin 2190 of the interior component/portion 2115 to an interior surface of the back panel 2120 of the exterior component/portion 2310 at a distance above the bottom edge/margin 2180 of the exterior component/portion 2310, as can be seen in FIGS. 24 and 25A. To put it another way, a distance 2410 from the collar edge 2154 to the bottom edge/margin 2190 of the interior component/portion 2115 may be less than a distance 2420 between the collar edge 2154 to the bottom edge/margin 2180 of the at least one back panel 2120 of the exterior component/portion 2310. The bottom edge/margin 2190 of the interior component/portion 2115 may be affixed to the at least one back panel 2120 of the exterior component/portion 2310 by stitching, heat pressing, adhesive bonding, or any other suitable means, or combination of means to form a permanent bond in accordance with aspects herein. FIG. 26 depicts a flow chart outlining a method 2600 for manufacturing a garment, such as the garments 100 and/or 2100 shown in FIGS. 1-6 and 21-25B, for example, in accordance with aspects herein. The method 2600 starts at step 2610 where an interior component/portion comprising at least one back panel, a first sleeve, and a second sleeve is provided. The method 2600 further comprises providing an exterior component/portion comprising at least one front panel, and at least one back panel, as outlined at step 2620. Furthermore, the method comprises step 2630 of extending the exterior component/portion over the interior component/portion. At step 2540, the method 2500 further comprises affixing the exterior component/portion to the interior component/portion such that a first front edge of the first sleeve of the interior component/portion is joined to a first front edge of a first sleeve opening of the exterior component/portion, and where a second front edge of the second sleeve of the interior component/portion is joined to a second front edge of a second sleeve opening of the exterior component/portion. In accordance with aspects herein, the first sleeve opening and the second sleeve opening of the exterior component/portion are left fully detached from remaining portions of the first sleeve and the second sleeve of the interior component/portion. Finally, the construction of the garment is finalized at step 2650 by providing finishing touches to the garment such as cuffs, collars, waistbands, closing mechanisms, and the like.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Since many different garment styles may be made of the invention without departing from the scope thereof, it is to be understood that all matter herein set forth or shown in the accompanying drawings is to be interpreted as illustrative and not in a limiting sense.

Having thus described the invention, what is claimed is:

1. A garment comprising:

a shrug component comprising at least a back shrug panel having a collar edge and a bottom edge located opposite to the collar edge, a first sleeve having a first front edge, and a second sleeve having a second front edge when the garment is in an as-worn configuration; and a vest component extending over the shrug component, the vest component having at least one front panel and at least one back panel, wherein the at least one front panel and the at least one back panel, when joined to form the vest component define, in part, at least a neckline opening, a first sleeve opening, a second sleeve opening, and a waist opening, wherein the first sleeve opening is defined by at least a first front edge and the second sleeve opening is defined by at least a second front edge when the garment is in the as-worn configuration, wherein a first length extending from the collar edge to the bottom edge of the back shrug panel of the shrug component is less than a second length extending from the neckline opening to the waist opening of the at least one back panel of the vest component, wherein the first sleeve of the shrug component extends through the first sleeve opening of the vest component, the second sleeve of the shrug component extends through the second sleeve opening of the vest component, the first front edge of the first sleeve of the shrug component is directly joined to the first front edge of the first sleeve opening of the vest component, the second front edge of the second sleeve of the shrug component is directly joined to the second front edge of the second sleeve opening of the vest component, and the first sleeve opening and the second sleeve opening of the vest component are fully detached from remaining portions of the shrug component, and wherein an entirety of the bottom edge of the back shrug panel of the shrug component is seamed to the at least one back panel of the vest component.

2. The garment of claim 1, wherein the shrug component comprises a first stretchable material and the vest component comprises a second stretchable material.

3. The garment of claim 2, wherein the first stretchable material comprises a different stretch characteristic from the second stretchable material.

4. The garment of claim 2, wherein the first stretchable material is more stretchable than the second stretchable material.

5. The garment of claim 2, wherein the first stretchable material comprises a stretch knit fabric and the second stretchable material comprises a stretch woven fabric.

6. The garment of claim 5, wherein one or more of the stretch woven fabric of the at least one front panel of the vest component, the stretch woven fabric of the at least one back panel of the vest component, and the stretch knit fabric of the shrug component comprise moisture management materials.

7. The garment of claim 1, wherein the at least one back panel of the vest component comprises a plurality of openings.

8. The garment of claim 7, wherein the plurality of openings are formed by altering a weaving pattern for the at least one back panel of the vest component.

9. The garment of claim 1, wherein one or more of the at least one front panel of the vest component and the at least one back panel of the vest component comprise UV radiation blocking materials.

10. A method for manufacturing a garment comprising:

providing a shrug component comprising at least one back shrug panel having a collar edge and a bottom edge located opposite to the collar edge, a first sleeve comprising a first front edge, and a second sleeve comprising a second front edge;

providing a vest component comprising at least one front panel, and at least one back panel, wherein the at least one front panel and the at least one back panel, when joined to form the vest component define, in part, at least a neckline opening, a first sleeve opening, a second sleeve opening, and a waist opening, wherein the first sleeve opening is defined by at least a first front sleeve opening edge and the second sleeve opening is defined by at least a second front sleeve opening edge when the garment is in an as-worn configuration, and wherein a first length extending from the collar edge to the bottom edge of the at least one back shrug panel of the shrug component is less than a second length extending from the neckline opening to the waist opening of the at least one back panel of the vest component;

extending the vest component over the shrug component;

affixing the vest component to the shrug component such that the first front edge of the first sleeve of the shrug component is joined to the first front sleeve opening edge of the vest component, and wherein the second front edge of the second sleeve of the shrug component is joined to the second front sleeve opening edge of the vest component, and wherein the first sleeve opening and the second sleeve opening of the vest component are fully detached from remaining portions of the shrug component; and affixing an entirety of the bottom edge of the at least one back shrug panel of the shrug component to the at least one back panel of the vest component.

11. The method of claim 10, wherein the shrug component comprises a first pliable material and the vest component comprises a second pliable material.

12. The method of claim 11, wherein the first pliable material and the second pliable material are stretchable, and wherein the first pliable material is more stretchable than the second pliable material.

13. The method of claim 12, wherein the first pliable material is a stretch knit fabric and the second pliable material is a stretch woven fabric.

14. The method of claim 13, wherein one or more of the stretch knit fabric and the stretch woven fabric comprise moisture management materials.

15. The method of claim 13, wherein at least the stretch woven fabric comprises UV radiation blocking materials.

16. A garment comprising:

an interior component formed from a first material having a first modulus of elasticity, the interior component comprising at least one back panel having a collar edge and a bottom edge located opposite to the collar edge, a right sleeve, and a left sleeve, wherein the right sleeve comprises a first lower sleeve opening and a first upper sleeve opening, wherein the first upper sleeve opening is defined, in part, by a right sleeve front edge, and wherein the left sleeve comprises a second lower sleeve opening and a second upper sleeve opening, wherein the second upper sleeve opening is defined, in part, by a left sleeve front edge; and a sleeveless exterior component formed from a second material having a second modulus of elasticity extending, in part, over the interior component, the sleeveless exterior component comprising at least one front panel and at least one back panel, wherein the at least one front panel and the at least one back panel cooperate to form, in part, a collar opening, a right sleeve opening, a left sleeve opening, and a waist opening of the sleeveless exterior component, wherein the right sleeve opening and the left sleeve opening are defined, in part, by respective front edges and back edges, wherein the right sleeve and the left sleeve of the interior component extend through the right sleeve opening and the left sleeve opening of the sleeveless exterior component, respectively, wherein a first length extending from the collar edge to the bottom edge of the at least one back panel of the interior component is less than a second length extending from the collar opening to the waist opening of the at least one back panel of the sleeveless exterior component, wherein a right sleeve opening front edge of the sleeveless exterior component is directly joined to the right sleeve front edge of the interior component, and a left sleeve opening front edge of the sleeveless exterior component is directly joined to the left sleeve front edge of the interior component, wherein the right sleeve opening and the left sleeve opening of the sleeveless exterior component are fully detached from remaining portions of the interior component, and wherein an entirety of the bottom edge of the at least one back panel of the interior component is joined to the at least one back panel of the sleeveless exterior component.

17. The garment of claim 16, wherein the first material comprises a stretch knit fabric and the second material comprises a stretch woven fabric.

18. The garment of claim 16, wherein the second modulus of elasticity of the second material is greater than the first modulus of elasticity of the first material.

19. The garment of claim 16, wherein at least the second material comprises one or more of UV radiation blocking and moisture management properties.

20. The garment of claim 16, wherein the at least one back panel of the sleeveless exterior component comprises a plurality of openings.

* * * * *